US009064361B2

(12) United States Patent
Umeda

(10) Patent No.: US 9,064,361 B2
(45) Date of Patent: Jun. 23, 2015

(54) COIN DISPENSING APPARATUS

(71) Applicant: ASAHI SEIKO CO., LTD., Tokyo (JP)

(72) Inventor: Masayoshi Umeda, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 0 days.

(21) Appl. No.: 14/325,803

(22) Filed: Jul. 8, 2014

(65) Prior Publication Data

US 2015/0024668 A1 Jan. 22, 2015

(30) Foreign Application Priority Data

Jul. 21, 2013 (JP) ..... 2013-151199

(51) Int. Cl.
*G07D 1/00* (2006.01)
*G07D 9/00* (2006.01)

(52) U.S. Cl.
CPC ..... *G07D 1/00* (2013.01); *G07D 2201/00* (2013.01); *G07D 9/008* (2013.01)

(58) Field of Classification Search
CPC ..... G07D 1/00; G07D 9/008; G07D 2201/00
USPC ..... 453/18, 29, 30, 32–35, 49, 57; 194/342, 194/343, 344; 221/247, 248, 261, 277
See application file for complete search history.

(56) References Cited

U.S. PATENT DOCUMENTS 5,316,517 A 5/1994 Chiba et al.
5,607,352 A * 3/1997 Tani ..... 453/57
7,682,230 B2 3/2010 Enomoto
2007/0259613 A1 11/2007 Richardson et al.
2014/0170948 A1 6/2014 Enomoto

FOREIGN PATENT DOCUMENTS

EP 0596612 A2 5/1994
EP 2463829 A1 6/2012
GB 2402934 A 12/2004
JP 08-180231 7/1996
JP 2006-527876 12/2006

OTHER PUBLICATIONS

Search report from E.P.O., mail date is Oct. 9, 2014, 14176963.8-1953, (7 pages).

* cited by examiner

*Primary Examiner* — Mark Beauchaine
(74) *Attorney, Agent, or Firm* — Greenblum & Bernstein, P.L.C.

(57) ABSTRACT

A coin dispensing apparatus prevents excessive dispensing of coins without abruptly stopping a rotary disk. A movable guide member is provided in a carrying path of coins to be selectively located at a guiding position where the coins are guided toward a dispensing opening or a non-guiding position where the coins are not guided toward the dispensing opening. A movable stopper is provided in a dispensing passage communicating with the carrying path to be selectively located at a blocking position where the coins are blocked or a non-blocking position where the coins are not blocked to pass through the dispensing passage. During a dispensing operation, the guide member is located at the guiding position and the stopper is located at the non-blocking position. During a non-dispensing operation, the guide member is located at the non-guiding position and the stopper is located at the blocking position.

15 Claims, 20 Drawing Sheets

COIN DISPENSING APPARATUS

BACKGROUND OF THE INVENTION

1. Field of the Invention

The present invention relates to a coin dispensing apparatus and more particularly, to a coin dispensing apparatus capable of dispensing coins one by one while moving coins in conjunction with rotation of a rotary disk, by using a guide member for guiding the coins moved along a circular carrying path along with the rotating disk toward a dispensing opening.

The term "coin" used in this specification contains not only coins as currency but also tokens such as medals or the like as a substitute of coins.

2. Description of the Related Art

As the first prior art technique for the present invention, a coin dispensing apparatus disclosed in Japanese Non-Examined Patent Publication No. 8-180231 published in 1996 is known. With this prior-art coin dispensing apparatus, a lot of coins stored at random in a coin storing bowl are moved in conjunction with rotation of a rotary disk placed in a bottom hole of the coin storing bowl and then, the coins thus moved are guided in a radial direction of the disk with a guide pin formed to protrude from a base; finally, the coins thus guided are ejected by an ejecting device toward a coin outlet one by one. To prevent excessive payout, the rotation of the rotary disk is stopped suddenly after a predetermined number of the coins are dispensed in accordance with the amount to be paid out. (See Paragraph 0002.)

As the second prior art technique for the present invention, a coin ejecting technique disclosed in Japanese Non-Examined Patent Publication No. 2006-537876 published in 2006 is known. With this prior-art technique, coins in conjunction with rotation of a rotary disk are ejected with a guide pin provided to be capable of elastic rocking motion one by one. (See FIGS. 5 to 9 and Paragraphs 0007 to 0025.)

In recent years, there is the need to increase the speed of dispensing changes of coins in a coin dispensing apparatus. To answer this need, the rotation speed of the rotary disk has ever been increased.

In the event of dispensing of change, it is impermissible to dispense coins excessively. Therefore, with the above-described first prior-art coin dispensing apparatus, the rotation of the rotary disk is stopped abruptly after a predetermined number of the coins are dispensed, thereby preventing excessive payout. However, in the case where the rotation of the rotary disk is abruptly stopped in this way, inertial forces of the rotary disk and its related parts will be large. As a result, there arises an anxiety that the durability of the coin dispensing apparatus degrades.

In addition, with the above-described second prior-art technique where the coins are ejected using the guide pin, all the coins moved in conjunction with the rotation of the rotary disk are ejected. Thus, the coins are unable to be ejected selectively. In this way, with the second prior-art technique also, excessive payout is prevented by abruptly stopping the rotation of the rotary disk and accordingly, there arises an anxiety that the durability of the coin dispensing apparatus degrades similar to the first prior-art technique.

SUMMARY OF THE INVENTION

The present invention was created to solve the aforementioned problem of the first and second prior-art techniques and a chief object of the present invention is to provide a coin dispensing apparatus that prevents excessive dispensing or payout of coins without abruptly stopping a rotary disk.

Another object of the present invention is to provide a small-sized coin dispensing apparatus that prevents excessive dispensing of coins without abruptly stopping a rotary disk.

Still another object of the present invention is to provide a coin dispensing apparatus that prevents excessive dispensing of coins at a low cost.

The above objects together with others not specifically mentioned will become clear to those skilled in the art from the following description.

According to the present invention, a coin dispensing apparatus is provided, which comprises a rotary disk having apertures for receiving coins which are supplied from a coin source; a circular carrying path along which the coins received in the apertures are moved in conjunction with rotation of the disk; a guide member for guiding the coins which are moved along the carrying path toward a dispensing opening formed in the carrying path; and a dispensing passage through which the coins guided by the guide member are moved from the dispensing opening toward a coin outlet;

wherein a guide member driving device is provided for moving the guide member between a guiding position where the coins which are moved along the carrying path are guided toward the dispensing opening and a non-guiding position where the coins which are moved along the carrying path are not guided toward the dispensing opening;

a stopper is provided in in such a way as to be moved between a blocking position where the coins are blocked in the dispensing passage and a non-blocking position where the coins are able to pass through the dispensing passage;

an interlocking device is provided for interlocking the guide member and the stopper in such a way that the guide member is located at the non-guiding position when the stopper is located at the blocking position, and that the guide member is located at the guiding position when the stopper is located at the non-blocking position; and a controller is provided for controlling the guide member and the stopper in such a way that the guide member is located at the guiding position and the stopper is located at the non-blocking position during a dispensing operation, and that the guide member is located at the non-guiding position and the stopper is located at the blocking position during a non-dispensing operation.

With the coin dispensing apparatus according to the present invention, the guide member driving device is provided for moving the guide member between the guiding position and the non-guiding position, and the stopper is provided in such a way as to be moved between the blocking position and the non-blocking position. The movements of the guide member and the stopper are interlocked with each other by the interlocking device and furthermore, they are controlled by the controller in such a way that the guide member is located at the guiding position and the stopper is located at the non-blocking position during the dispensing operation, and that the guide member is located at the non-guiding position and the stopper is located at the blocking position during the non-dispensing operation.

Therefore, in the dispensing operation, the coins which are received in the apertures of the rotary disk and which are moved along the carrying path in conjunction with the rotation of the rotary disk are certainly guided toward the dispensing opening by the guide member. Moreover, the coins thus reached the dispensing opening are not blocked by the stopper in the dispensing passage. As a result, no problem will occur during the dispensing operation and the coins are dispensed smoothly.

After a predetermined number of the coins are dispensed, in other words, in the non-dispensing operation, the guide member is located at the non-guiding position and the stopper is located at the blocking position due to the operations of the interlocking device and the controller. Thus, the coins which are moved along the carrying path in conjunction with the rotation of the rotary disk are not guided to the dispensation opening by the guide member. For this reason, the coins which are moved along the carrying path are prevented from reaching the dispensing opening even if the rotary disk is being rotated. This means that there is no anxiety that the coins are dispensed in error.

Moreover, even if the coins which are moved along the carrying path reach the dispensing opening due to some reason in spite of the guiding member being at the non-guiding position, the coins are prevented from moving along the dispensing passage by the stopper. Accordingly, in this case also, there is no anxiety that the coins are dispensed in error even if the rotary disk is being rotated.

In this way, with the coin dispensing apparatus according to the present invention, performing the dispensing operation and stopping the dispensing operation can be selected using the controller even if the rotary disk is being rotated and thus, there is no need to stop the rotation of the rotary disk abruptly. This means that there arises no anxiety that the durability of the coin dispensing apparatus degrades.

Accordingly, excessive dispensing or payout of the coins can be prevented without abruptly stopping the rotary disk.

In a preferred embodiment of the coin dispensing apparatus according to the present invention, the interlocking device comprises a mechanical linking device or mechanism. In this embodiment, there is an additional advantage that the interlocking device can be fabricated with a smaller size at a lower cost compared with an electric linking device or mechanism.

In another preferred embodiment of the coin dispensing apparatus according to the present invention, the interlocking device comprises an electric actuator. In this embodiment, there is an additional advantage that the interlocking device can be fabricated with a simple structure at a low cost and that troubles are seldom produced.

In still another preferred embodiment of the coin dispensing apparatus according to the present invention, the stopper is structured to protrude from a bottom of the dispensing passage and to sink below the bottom of the dispensing passage, and the guide member is rockably supported by a shaft and is biased resiliently toward the guide position, wherein the guide member is movable to the non-guide position by an actuator.

In a further preferred embodiment of the coin dispensing apparatus according to the present invention, the mechanical linking device or mechanism as the interlocking device comprises an interlocking lever formed integrally with the guide member, a rocking lever rockably supported by a shaft and linked with the stopper, and an actuator;

wherein when the guide member is moved to the non-guiding position by the actuator, the interlocking lever moves the stopper to the blocking position against a resilient force by way of the rocking lever, and when the guide member is moved to the guiding position by the actuator, the interlocking lever is detached from the rocking lever and the stopper is moved to the non-blocking position by the resilient force.

In a still further preferred embodiment of the coin dispensing apparatus according to the present invention, a rocking motion limiter and a spring receiver are respectively provided at a front position and a rear position with respect to a rocking direction of the guide member, wherein a spring for resiliently biasing the guide member toward the rocking motion limiter is provided between the spring receiver and the guide member.

In a still further preferred embodiment of the coin dispensing apparatus according to the present invention, the guide member driving device comprises a position selector; wherein the position selector is selectively located between a dispensing assisting position where the guide member is located at the guiding position and a non-dispensing assisting position where the guide member is located at the non-guiding position.

In a still further preferred embodiment of the coin dispensing apparatus according to the present invention, a rotary encoder that detects a rotation phase of the rotary disk is provided, wherein rotation of the rotary disk is stopped based on a rotation phase signal from the rotary encoder in such a way that the coins are not overlapped with a protruding position of the guide member. In this embodiment, there is an additional advantage that the motion of the guide member toward the guide position is not obstructed by the coins and therefore, the coins can be certainly dispensed one by one and excessive dispensing or payout is unlikely to occur.

BRIEF DESCRIPTION OF THE DRAWINGS

In order that the present invention may be readily carried into effect, it will now be described with reference to the accompanying drawings.

DETAILED DESCRIPTION OF THE INVENTION

Figure 1:
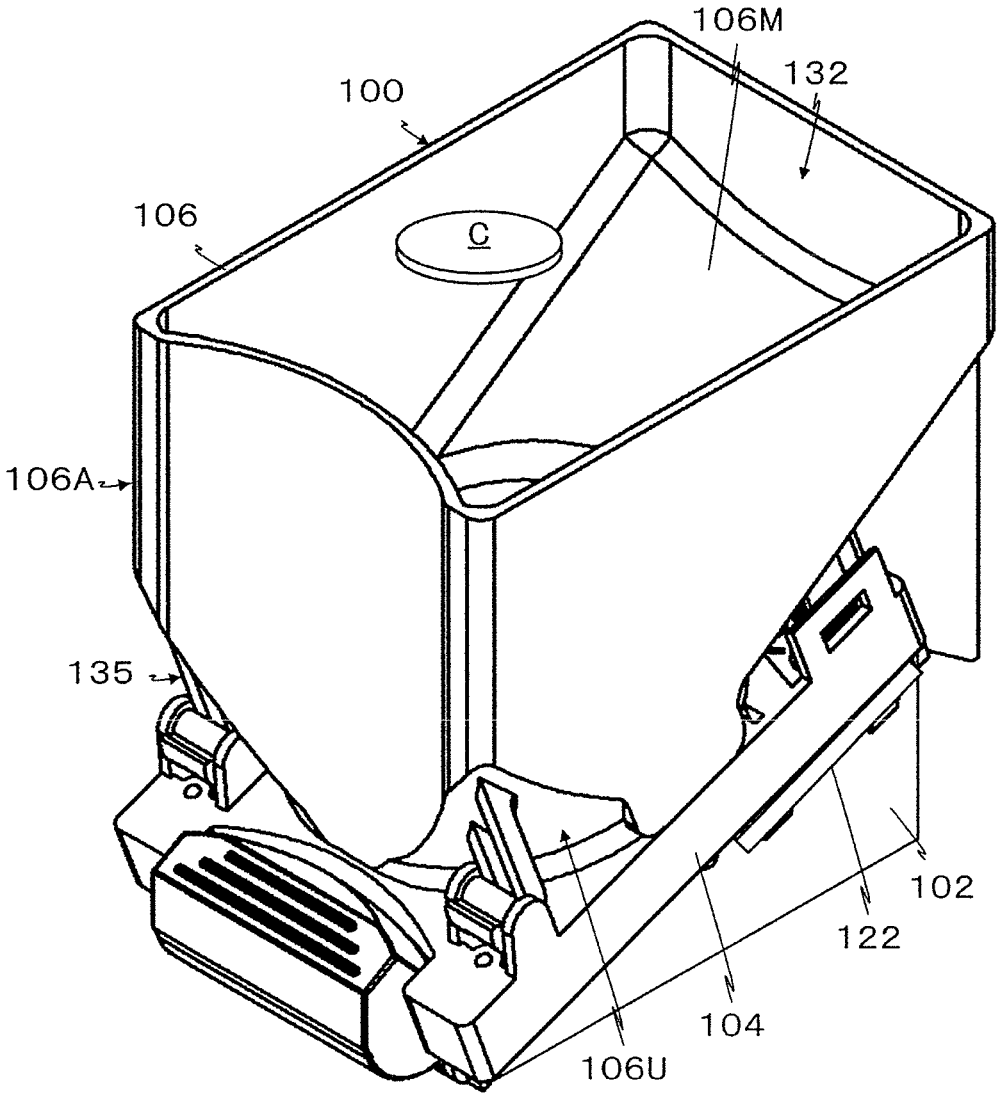
FIG. 1 is a perspective view of a coin dispensing apparatus according to a first embodiment of the present invention.

Preferred embodiments of the present invention will be described in detail below while referring to the drawings attached.

First Embodiment

A coin dispensing apparatus 100 according to a first embodiment of the present invention is shown in FIGS. 1 to 17. The apparatus 100 has the function of separating coins C that have been randomly collected and then, dispensing the coins C one by one.

[Overall Structure of Coin Dispensing Apparatus]

Figure 2:
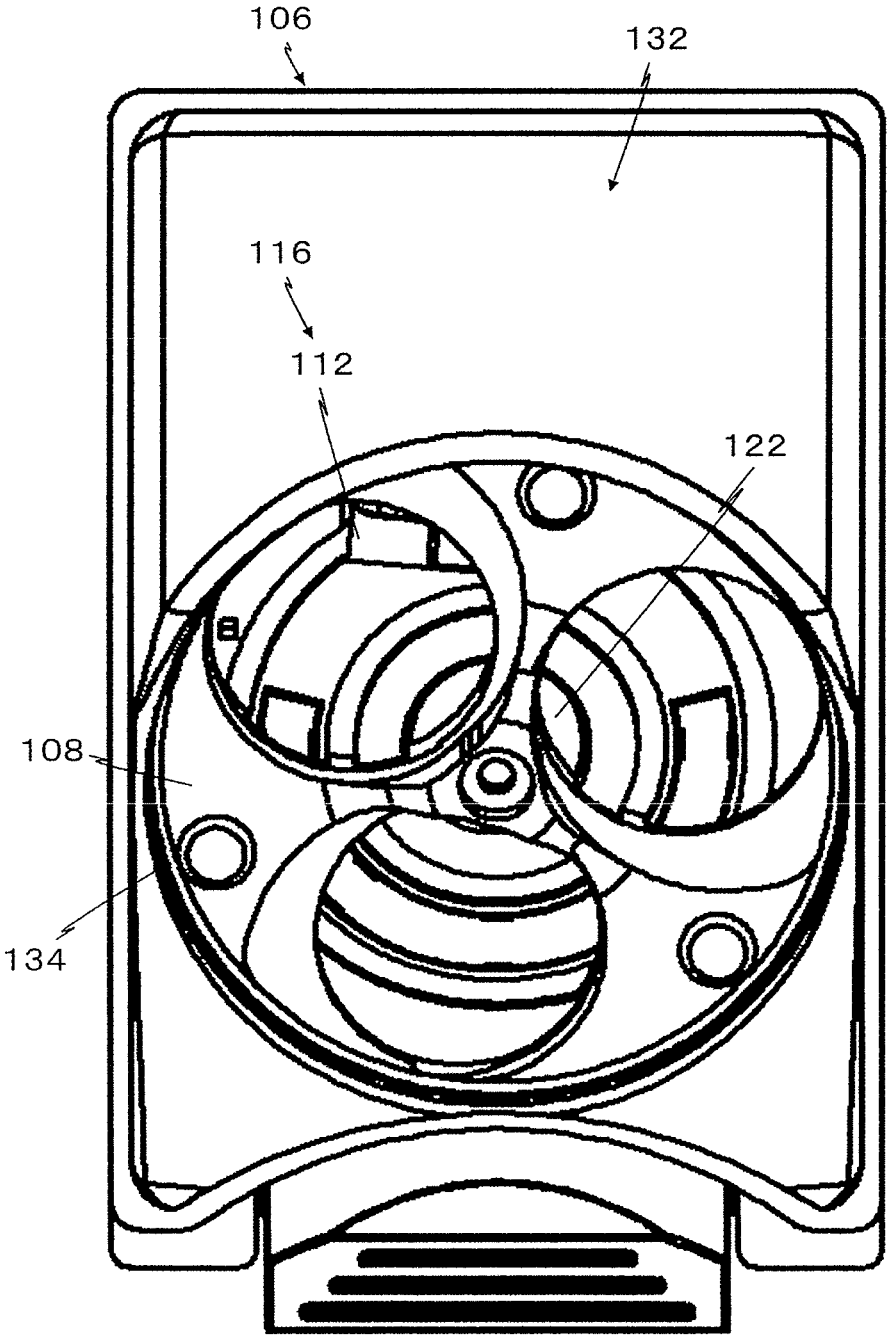
FIG. 2 is a plan view of the coin dispensing apparatus according to the first embodiment of the present invention.
Figure 3:
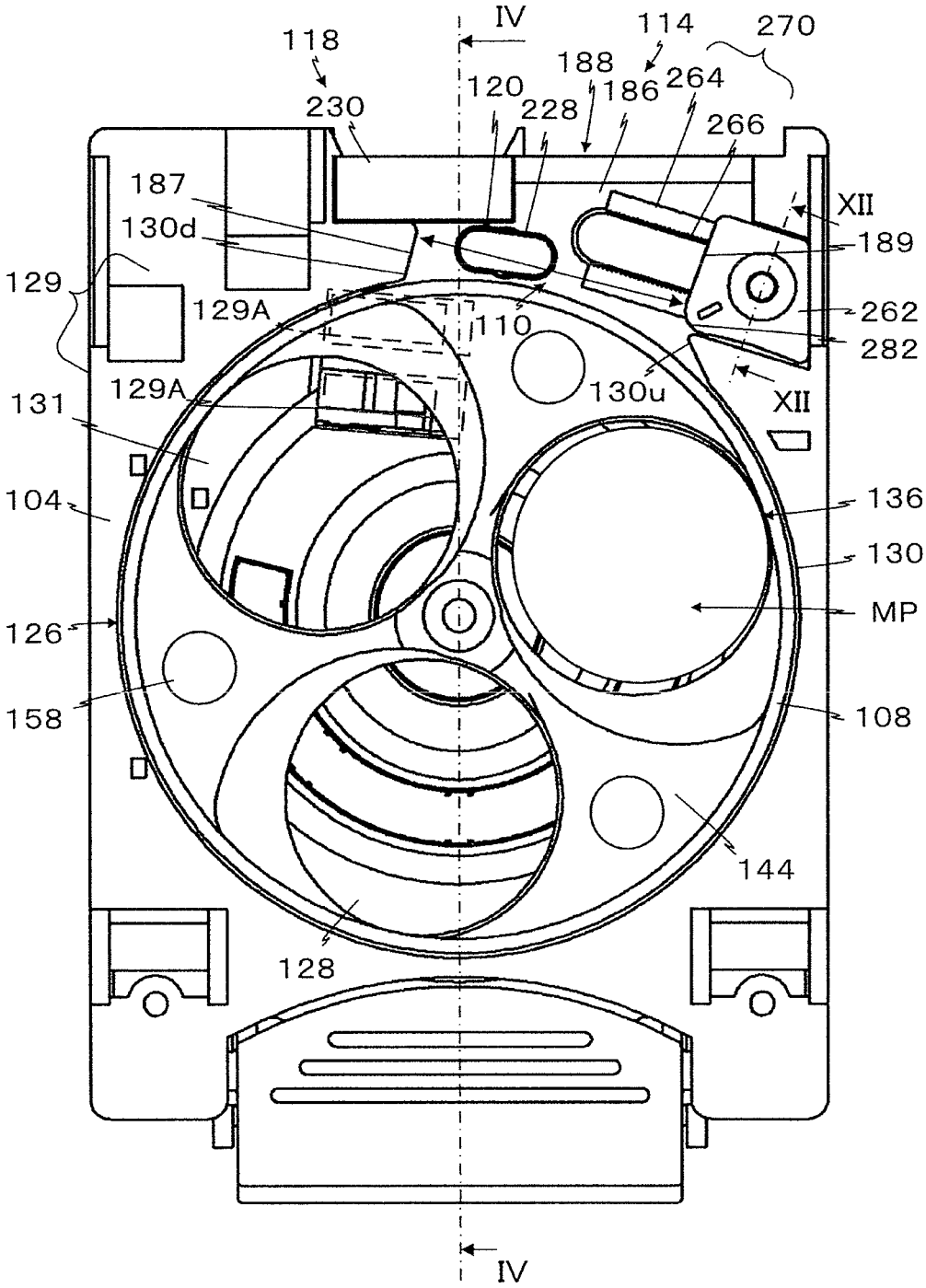
FIG. 3 is a plan view showing the coin dispensing apparatus according to the first embodiment of the present invention, where the coin storing bowl is removed.

As shown in FIGS. 1 to 3, the coin dispensing apparatus 100 according to the first embodiment comprises a frame 102, a base 104, a coin storing bowl or coin container 106, a rotary disk 108, a dispensing opening 110, a guide pin or guide member 112, a dispensing passage 114, an ejecting device 116, a coin sensor 118, a stopper 120, and a control circuit 122. The frame 102, the base 104, the coin storing bowl 106, the rotary disk 108, the dispensing opening 110, the dispensing passage 114, and the coin sensor 118 have known structures, respectively. The feature of the present invention relates to the guide pin 112 and the stopper 120.

Here, the base 104 (and the frame 102) may be termed the "body", because the rotary disk 108 is rotatably installed on the base 104 and various driving/controlling devices and members for the disk 108 (which will be described later) are mounted on the base 104. The body may comprise the frame 102 in addition to the base 104.

Since the coin storing bowl or coin container 106 serves as a coin source for supplying coins to the disk 108, it may be termed a coin source.

The frame 102 has the structure on which the predetermined functional parts such as the base 104, the coin storing bowl 106, and the control circuit 122 can be formed. In this first embodiment, the frame 102 is formed by a synthetic resin and comprises the shape like a hollow triangular pillar whose top end face is opened. The top end opening of the frame 102 is covered with the base 104.

An electric motor 124, which comprises reduction gears and which is rotatable in forward and reverse directions, is fixed on the back of the base 104. The output shaft 125 of the motor 124 is protruded upward from the base 104 by way of a circular penetrating hole 128 formed in the base 104. In the event of a coin jam, the motor 124 is rotated in the reverse direction by one or several turns within a specific time period, thereby releasing the coin jam automatically.

In addition, the rotation number of the rotary disk 108 in the reverse direction is not limited to time-dependent control. The rotary disk 108 may be rotated in the reverse direction by a predetermined angle based on the output from an encoder 127 mounted with respect to the output shaft 125 of the motor 124.

In this first embodiment, the base 104 is mounted to be inclined to the horizontal plane. The dispensing opening 110 may be positioned on the upper or lower side of the inclined part of the base 104. The base 104 may be placed horizontally, in other words, parallel to the horizontal plane.

Figure 4:
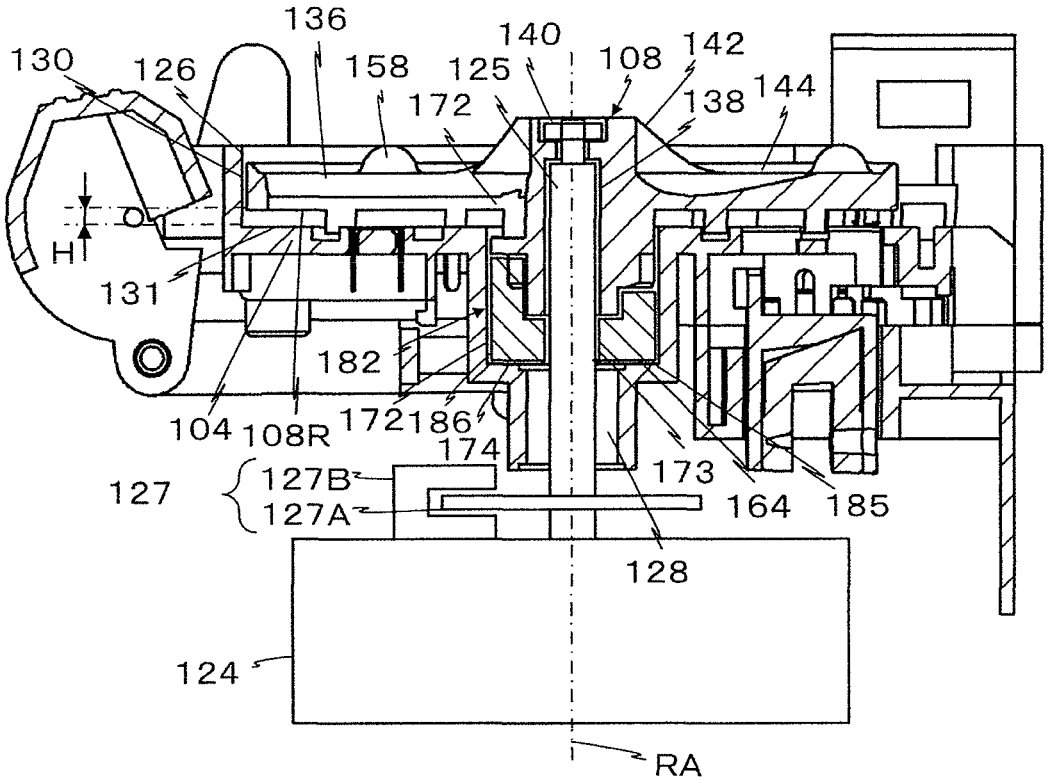
FIG. 4 is a cross-sectional view along the line XI-XI in FIG. 3.

The rotary encoder 127 outputs information about the rotation phase of the rotary disk 108, as shown in FIG. 4. In other words, to prevent the rotary disk 108 from being stopped in the state where the coins C moved in conjunction with the rotary disk 108 are overlapped with an advance/retreat hole 129 described later, the rotation phase of the disk 108 is detected by the rotary encoder 127. Accordingly, the rotary encoder 127 may be replaced with other device having a similar function.

In this embodiment, the rotary encoder 127 is mounted below the base 104 and comprises a grid disk 127A fixed to the output shaft 125 of the motor 124 and a photoelectric sensor 127B fixed to the base 104. The grid disk 127A comprises slits formed on the annular periphery of the disk 127A at constant intervals. The photoelectric sensor 127B detects the slits of the grid disk 127A.

Figure 5:
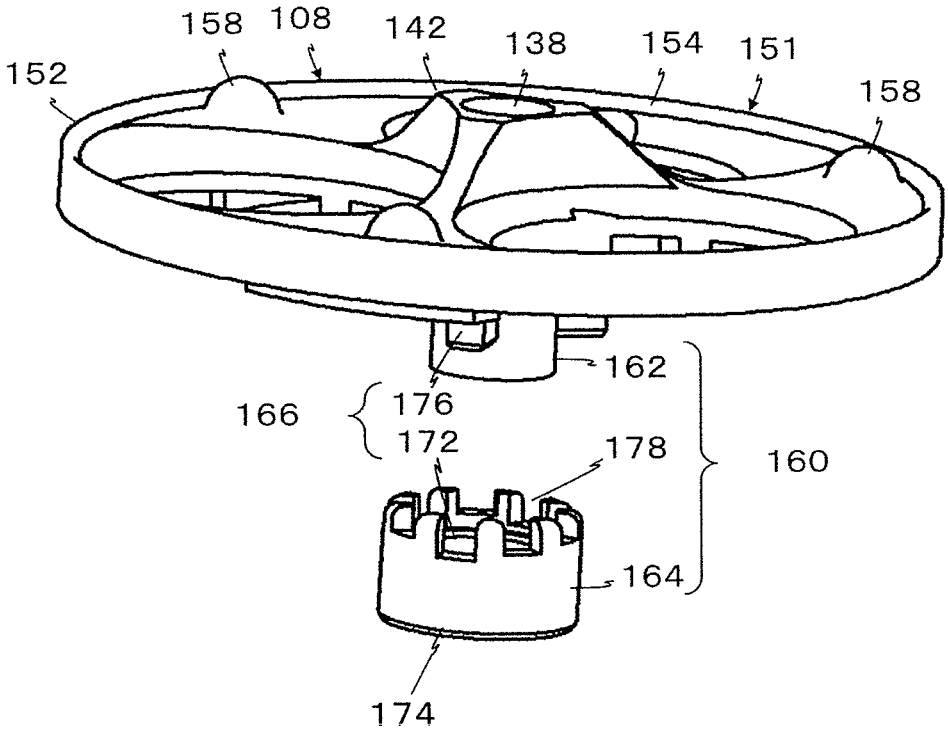
FIG. 5 is a perspective view of the rotary disk used in the coin dispensing apparatus according to the first embodiment of the present invention.

As shown in FIGS. 4 and 5, the base 104 has a shape like a rectangular flat plate with a predetermined thickness. A disk receiving hole 126 is formed on the upper surface of the base 104. The coin storing bowl 106 can be attached to the same upper surface.

The disk receiving hole 126 is defined by a circular plate-shaped bottom face 131 and an annular coin guiding wall 130 extending along the periphery of the bottom face 131. In other words, the disk receiving hole 126 is formed by the combination of the bottom face 131 and the coin guiding wall 130. The disk receiving hole 126 has the shape of a circular pan in which the rotary disk 106 is placed rotatably.

The depth of the disk receiving hole 126 is set to be slightly larger than the thickness of the rotary disk 108, and the bottom face 131 is formed to be approximately flat in such a way that the coin C is slid on the bottom face 131 while the surface or back of the coin C is in contact with the bottom face 131. The circular coin guiding wall 130 guides the annular peripheral face of the coin C.

It is preferred that the base 104 is formed by a metal such as stainless steel, or a flat plate made of a synthetic resin with abrasion resistance.

In this embodiment, the circular disk receiving hole 126 is formed directly in the upper surface of the base 104. However, the present invention is not limited to this. The circular disk receiving hole 126 may be formed by the combination of two flat plates, i.e., by placing a perforated flat plate with a circular hole on another flat plate.

The base 104 may be replaced with another member or structure having the same or similar function.

The coin storing bowl 106 stores a lot of coins C in the randomly collected state. In this embodiment, the coin storing bowl 106 is made of a synthetic resin and has the shape like a vertically extending tube. The inside of the bowl 106 constitutes a coin storing section 132 which extends vertically.

The horizontal cross section of the upper part 106A of the coin storing section 132 is rectangular and the horizontal cross section of the lower part 106B of the section 132 is the same as that of the circular bottom hole 134 formed in the lower part 106B. The middle part 106M of the section 132 between the upper and lower parts 106A and 106B thereof comprises an inclined wall on which the coins C can be slid down.

The lower end face of the coin storing bowl 106 (i.e., the lower end face of the lower part 106B) is opposed to the upper surface of the base 104. The lower end face of the bowl 106 is detachably attached to the base 104 with a fixing device 135 at a position where the central axis of the disk receiving hole 126 is in accordance with the axis of the circular bottom hole 134.

The coin storing bowl 106 may be replaced with another device or structure having the same or similar functions (i.e., the storing and sending functions of the coins C).

[Rotary Disk]

Next, the rotary disk 108 will be explained in detail with reference to FIGS. 5 to 8.

The rotary disk 108 is rotated at a predetermined speed, thereby stirring the coins C in the coin storing bowl 106. Due to this stirring, the coins C are dropped in apertures 136 formed at eccentric positions of the disk 108 and moved or rotated in conjunction with the rotation of the disk 108. In the event of a coin jam, in other words, when the state where the coins C are not dispensed due to jamming of the coins C occurs, the disk 108 is rotated in the reverse direction for the purpose of resolving the coin jam.

In this embodiment, the rotary disk 108 is rotatably mounted in the disk receiving hole 126 formed in the upper surface of the base 104. The disk 108 is rotated at a predetermined speed in a counterclockwise direction in FIG. 2 by the DC electric motor 124 mounted on the back side of the base 104 during the dispensing period, and rotated at a predetermined speed in a clockwise direction in FIG. 2 within a predetermined period when a coin jam occurs.

The end of the output shaft 125 of the motor 124 is inserted into an attaching hole 138 formed at the center of the rotary disk 108. The output shaft 125 is combined with the disk 108 by a nut 140 which is screwed into the threaded part of the shaft 125 (See FIG. 4).

Figure 7:
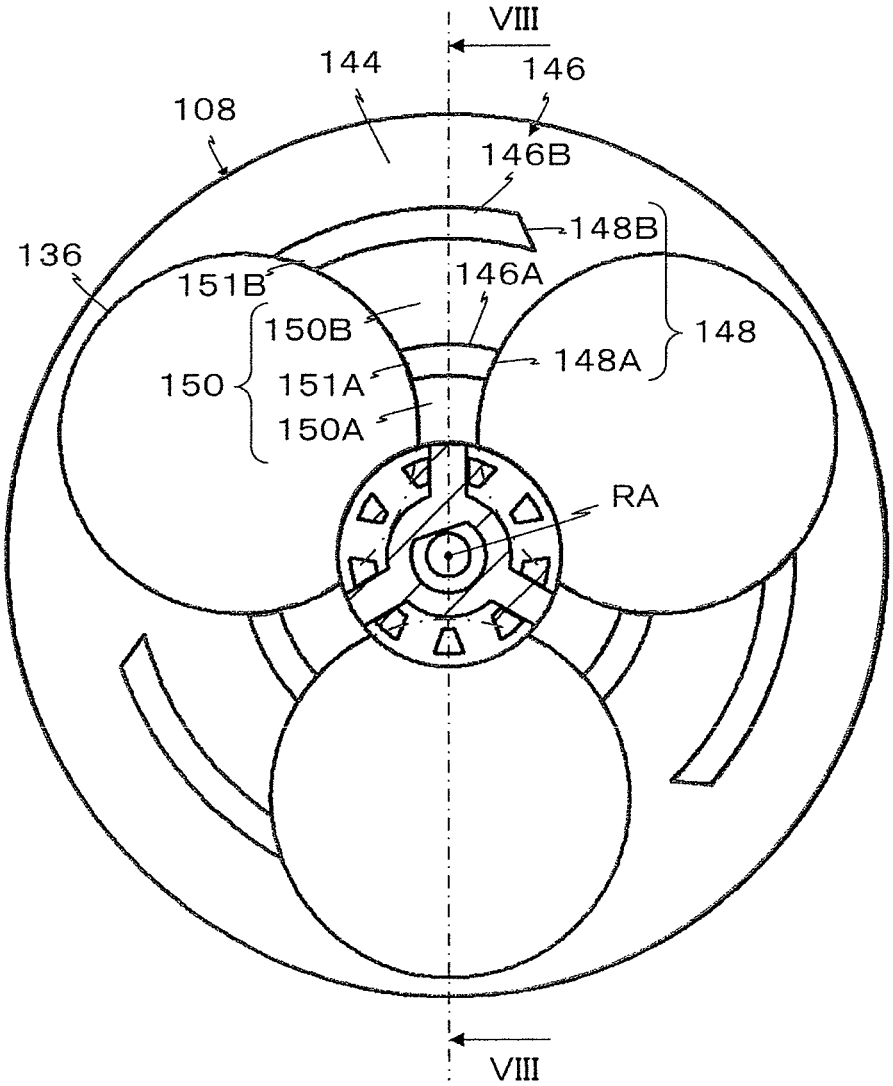
FIG. 7 is a rear view of the rotary disk used in the coin dispensing apparatus according to the first embodiment of the present invention.
Figure 8:
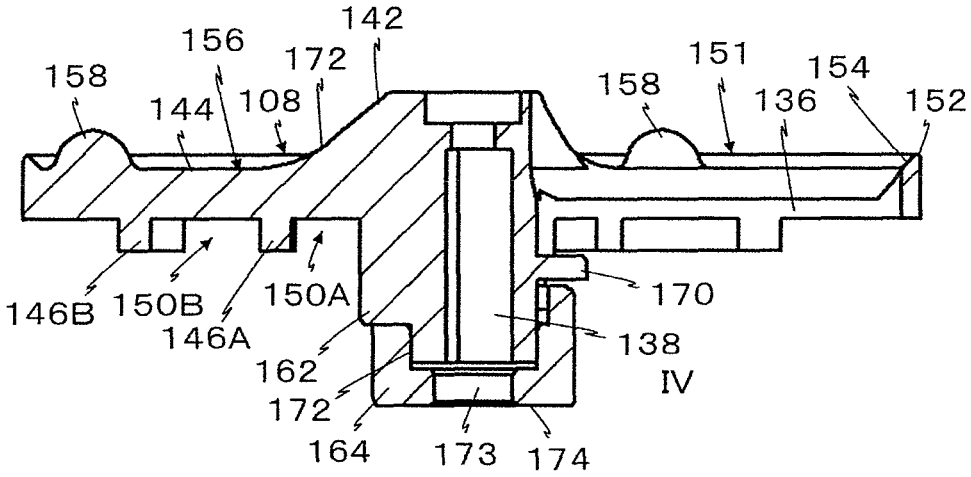
FIG. 8 is a cross-sectional view along the line VIII-VIII in FIG. 7.

Stirring parts 142 having a shape like a truncated pyramid are formed on the upper surface of the rotary disk 108 (See FIGS. 7 and 8). The stirring parts 142 are rotated in the bottom hole 134 of the bowl 106 in conjunction with the rotation of the disk 108 in the bottom hole 134. For this reason, the coins C in the bowl 106 can be stirred certainly and at the same time, the dropping of the coins C from the bowl 106 into the apertures 136 of the disk 108 can be facilitated.

As shown in FIGS. 7 and 8, a plurality of ribs 144 are formed among the apertures 136 of the rotary disk 108, and curved pressing members 146 are formed on the rear face 108R of the disk 108. The pressing members 146 have a curved shape extending approximately radially with respect to the disk 108. The pressing members 146 are rotated in the disk receiving hole 126 in conjunction with the rotation of the disk 108.

As clearly shown in FIG. 7, the shape of the front face 148 of each pressing member 146 (i.e., the pressing face) is such that the front face 148 is shifted backward as it approaches the periphery of the rotary disk 108. In detail, as the pressing members 146 in this embodiment, first pressing members 146A are formed near the rotation axis RA and second pressing members 146B are formed near the periphery of the disk 108.

To enable a first guide pin portion 112A and a second guide pin portion 112B, both of which constitute the guide pin 112 which will be described in detail later, to pass through, arc-shaped first clearance grooves 150A are formed near the rotation axis RA and arc-shaped second clearance grooves 150B are formed between the first pressing members 146A and the second pressing members 146B. The front faces of the first pressing members 146A correspond to the first pressing faces 148A, and the front faces of the second pressing members 146B correspond to the second pressing faces 148B.

On the upper surface 151 of the rotary disk 108, an inclined face 154 which is directed downward toward the central part of the disk 108 from the peripheral part 152 thereof. The middle part 156 surrounded by the inclined face 154 is approximately flat. However, the neighborhood of the attaching hole 138 into which the output shaft 125 of the electric motor 124 is inserted is mounded in such a way as to form a truncated pyramid, forming the stirring parts 142.

In the vicinity of the peripheral part 152 of the disk 108, stirring protrusions 158 are formed on the ribs 144.

[Height Adjusting Mechanism for Rotary Disk]

In the central part of the lower surface of the rotary disk 108, a height adjusting mechanism or device 160 for adjusting the height of the disk 108 is mounted (See FIG. 5). The height adjusting mechanism 160 has the function of adjusting the first distance H1 to an appropriate interval corresponding to the thickness of the coin C. The term "height" described here means the first distance H between the bottom face 131 of the base 104 and the rear face 108R of the disk 108, as shown in FIG. 4.

In this embodiment, the height adjusting mechanism or device 160 comprises an inner tube member 162 that protrudes downward from the center of the rear face 108R of the disk 108, an outer tube member 164 to be fitted on the outside of the inner tube member 162, and an engaging part 166 formed with reference to the inner and outer tube members 162 and 164.

The inner tube member 162 constituting a part of the height adjusting mechanism 160 is a cylindrical member having a predetermined radius whose center is located at the rotation axis RA and a predetermined length, where the member 162 is placed around the attaching hole 138 of the disk 108. In other words, the inner tube member 162 is a cylindrical member protruding downward from the central part of the rear face 108R of the disk 108. On the middle part of the inner tube member 162, a flange 170 with a predetermined thickness is formed to surround the member 162. The first interval H1 between the upper face of the flange 170 and the rear face 108R of the disk 108 is determined to be slightly larger than the second height H2 corresponding to the height of the pressing members 146. This means that the upper face of the flange 170 is not closer to the rear face 108R than the bottom face 131 of the disk receiving hole 126 even if the position of the disk 108 is determined corresponding to the maximum thickness of the coins C.

In addition, if the diameter of the apertures 136 of the rotary disk 108 in which the coins C are placed is small, the foot 172 of the stirring part 142 will be relatively large and as a result, the inner tube member 162 will be entirely overlaid on the foot 172. Therefore, in this case, the flange 170 is unnecessary to be formed.

The outer tube member 164 constituting another part of the height adjusting mechanism 160 is a cylindrical member having a predetermined length. The upper end of a fitting hole 172 formed in the outer tube member 164 can be fitted into the lower part of the inner tube member 162 (See FIGS. 6A and 6B).

As shown in FIG. 8, subsequent to the lower end of the fitting hole 172, a penetrating hole 173 having a diameter smaller than the fitting hole 172 is formed to be concentric with the fitting hole 172. In other words, as shown in FIG. 4, the fitting hole 172 and the penetrating hole 173 are formed continuously in the vertical direction, resulting in a stepped hole. The fitting hole 172 forming the upper part of the stepped hole has a larger diameter than the penetrating hole 173 forming the lower part thereof.

The lower end face 174 of the outer tube member 164 is a flat face parallel to the upper face 151 of the rotary disk 108. For this reason, when the disk 108 is rotated in such a way that the lower end face 174 is in surface contact with an opposing face, the disk 108 will be rotated in a plane parallel to this opposed face.

Figure 6A:
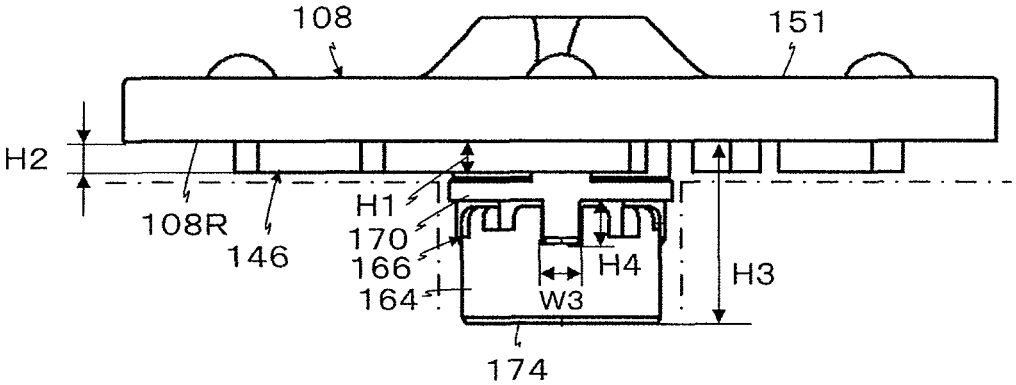
FIG. 6A is a side view of the rotary disk used in the coin dispensing apparatus according to the first embodiment of the present invention, where a height adjusting device is attached to the rotary disk.
Figure 6B:
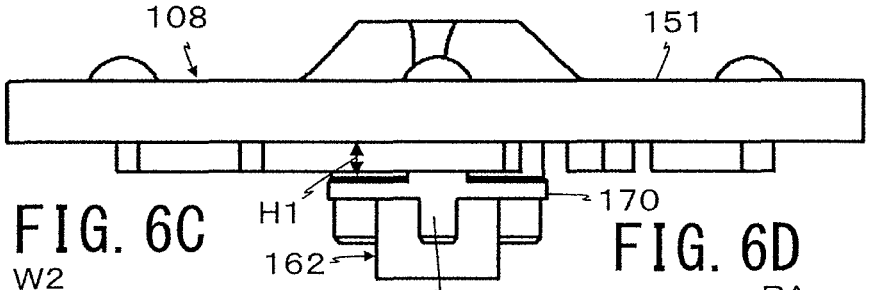
FIG. 6B is a side view of the rotary disk used in the coin dispensing apparatus according to the first embodiment of the present invention, where the height adjusting device is detached from the rotary disk.

The engaging part 166 constituting the remaining part of the height adjusting mechanism 160 has the function of changing stepwise the third distance H3 between the lower end face 174 of the outer tube member 164 and the rear face 108R of the disk 108, and the function of eliminating the phase gap between the inner and outer tube members 162 and 164, as shown in FIGS. 5 and 6A. The engaging part 166 comprises a disk-side engaging subpart 176 and an outer tube-side engaging subpart 178, as shown in FIG. 5.

The disk-side engaging subpart 176 has the function of blocking relative rotation of the outer tube member 164 with respect to the inner tube member 162 in cooperation with the outer tube-side engaging subpart 178. The disk-side engaging subpart 176 is a protrusion having a rectangular cross section, which is protruded downward from the back of the flange 170 of the inner tube member 162. The disk-side engaging subpart 176 is extended from the outer surface of the inner tube member 162 in a radial direction of the member 162.

Figure 6C:
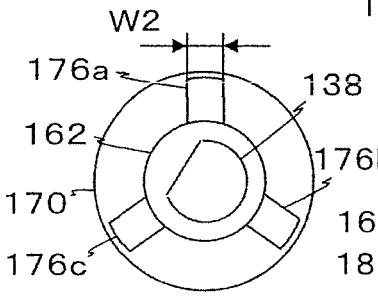
FIG. 6C is a bottom view of the inner cylinder of the height adjusting device used in the coin dispensing apparatus according to the first embodiment of the present invention.

In this embodiment, as shown in FIG. 6C, the disk-side engaging subpart 176 is extended to the vicinity of the peripheral part of the flange 170. However, if the disk-side engaging subpart 176 has the function of blocking relative rotation of the outer tube member 164 with respect to the inner tube member 162, it is not always necessary for the subpart 176 to be extended to the vicinity of the peripheral part of the flange 170.

Moreover, in this embodiment, as clearly shown in FIG. 6C, the disk-side engaging subpart 176 is formed to have a Y-shaped structure by three elongated protrusions which have the same shape and which are arranged at equal angles of 120 degrees, i.e., a first elongated protrusion 176*a*, a second elongated protrusion 176*b*, and a third elongated protrusion 176*c*. In other words, the first elongated protrusion 176*a*, the second elongated protrusion 176*b*, and the third elongated protrusion 176*c* are formed to be radially with respect to the rotation axis RA. However, if the rotary disk 108 can be held to be parallel to the base 104 even during rotation, the count of the elongated protrusions may be one or two. The count of the elongated protrusions may be four or more.

In this embodiment, the first, second, and third elongated protrusions 176*a*, 176*b* and 176*c* have the same rectangular cross section and the same dimensions. In addition, the third widths W3 of the first, second, and third elongated protrusions 176*a*, 176*b* and 176*c* are set to be equal to each other, as shown in FIG. 6A.

The outer tube-side engaging subpart 178 has the function of setting stepwise the position of the outer tube member 164 with respect to the rear face 108R of the rotary disk 108 and the function of blocking relative rotation between the inner and outer tube members 162 and 164, both of which are realized in cooperation with the disk-side engaging subpart 176. The outer tube-side engaging subpart 178 comprises receiving recesses 180 having rectangular cross sections, which are formed on the disk-side end face (in other words, the upper end face) of the outer tube member 164. The count of the receiving recesses 180 is an integral multiple of the number of the disk-side engaging subparts 176. Specifically, when the number of the disk-side engaging subparts 176 is 2, the number of the outer tube-side engaging subparts 178 is set to be an integral multiple of 2, such as 4, 6, and 8; moreover, the positional relationship among the outer tube-side engaging subparts 178 is determined in accordance with the arrangement of the disk-side engaging subparts 176.

In this embodiment, the count of the receiving recesses 180 is set to be three times as much as the disk-side engaging subparts 176. Concretely speaking, the number of the disk-side engaging subparts 176 is 3 and the count of the receiving recesses 180 is 9 (i.e., three times as much as 3). Thus, the first receiving recess 180*a*, the second receiving recess 180*b*, the third receiving recess 180*c*, the fourth receiving recess 180*d*, the fifth receiving recess 180*e*, the sixth receiving recess 180*f*, the seventh receiving recess 180*g*, the eighth receiving recess 180*h*, and the ninth receiving recess 180*i* are formed to have the same fourth width W4 at predetermined pitches on the upper face of the outer tube member 164.

Figure 6D:
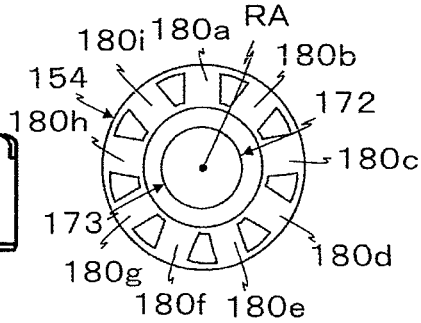
FIG. 6D is a top view of the outer cylinder of the height adjusting device used in the coin dispensing apparatus according to the first embodiment of the present invention.

As shown in FIG. 6D, the first to ninth receiving recess 180*a* to 180*i* are formed to be radially with respect to the rotation axis RA of the rotary disk 108. Each of the first to ninth receiving recess 180*a* to 180*i* has one of the first, second, and third depths D1, D2, and D3, and every three ones of the first to ninth receiving recess 180*a* to 180*i* are equal in depth. Specifically, three of the first to ninth receiving recess 180*a* to 180*i* arranged at equal angles of 120 degrees, which are respectively opposed to the first, second, and third elongated protrusions 176*a*, 176*b*, and 176*c*, have the same depth of D1, D2 or D3. In this embodiment, the first, fourth and seventh receiving recess 180*a*, 180*d* and 180*g* have the same depth of D1, the second, fifth and eighth receiving recess

180*b*, 180*e* and 180*h* have the same depth of D2, and the third, sixth and ninth receiving recess 180*c*, 180*f* and 180*i* have the same depth of D3.

Figure 6E:
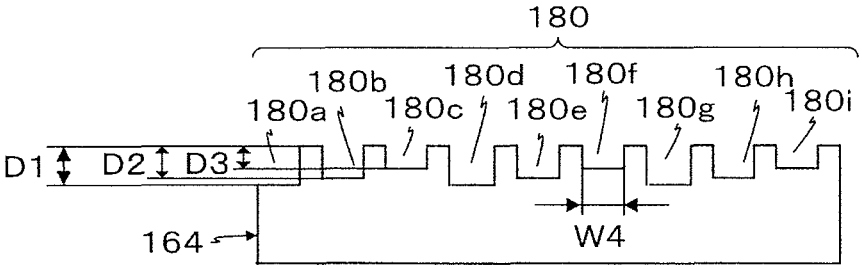
FIG. 6E is a developed view of the outer cylinder of the height adjusting device used in the coin dispensing apparatus according to the first embodiment of the present invention.

Moreover, as shown in FIG. 6E, the widths of the first to ninth receiving recess 180*a* to 180*i* are set to be equal to the fourth width W4 in such a way as to be detachably engaged with and to be closely fitted to a corresponding one of the first, second, and third elongated protrusions 176*a*, 176*b*, and 176*c*.

In this embodiment, the first to ninth receiving recess 180*a* to 180*i* have the same width of W4 and the depth of D1, D2 or D3. In accordance with the radial arrangement of the first, second, and third elongated protrusions 176*a*, 176*b*, and 176*c*, three of the receiving recess 180*a* to 180*i* arranged at every 120 degrees constitute one group.

If this is explained using the first receiving recess 180*a* as the reference, as shown in FIG. 6E, the first, fourth and seventh receiving recess 180*a*, 180*d* and 180*g* constitute one group, the second, fifth and eighth receiving recess 180*b*, 180*e* and 180*h* constitute another group, and the third, sixth and ninth receiving recess 180*c*, 180*f* and 180*i* constitute a last group.

If the engaging subpart 166 is formed as described in this embodiment, there is an additional advantage that the rear face 108R of the rotary disk 108 and the lower face 174 of the outer tube member 164 can be made parallel easily.

The width W4 of the first to ninth receiving recesses 180*a* to 180*i* is slightly wider than the width W3 of the first to third elongated protrusions 176*a* to 176*c* and therefore, each of the first to third elongated protrusions 176*a* to 176*c* can be fitted into a corresponding one of the first to ninth receiving recesses 180*a* to 180*i*. Moreover, the depths of the first to ninth receiving recesses 180*a* to 180*i* are set to be equal to each other for each of the aforementioned three groups of the receiving recesses as explained in detail below.

Concretely speaking, the first, fourth and seventh receiving recesses 180*a*, 180*d* and 180*g* arranged at equal angles of 120 degrees have the first depth D1, which is the deepest. The second, fifth and eighth receiving recesses 180*b*, 180*e* and 180*h* arranged at equal angles of 120 degrees have the second depth D2, which is the second deepest. The third, sixth and ninth receiving recesses 180*c*, 180*f* and 180*i* arranged at equal angles of 120 degrees have the depth D3, which is the shallowest.

The first depth D1 is larger than the fourth height H4 of the disk-side engaging subpart 176. This means that when the first elongated protrusion 176*a*, the second elongated protrusion 176*b*, and the third elongated protrusion 176*c* are respectively fitted into the first, fourth and seventh receiving recess 180*a*, 180*d* and 180*g*, the end face of the outer tube member 164 abuts against the back of the flange 170 and at the same time, the lower ends of the first, second and third elongated protrusions 176*a*, 176*b* and 176*c* do not abut against the bottom faces of the first, fourth and seventh receiving recess 180*a*, 180*d* and 180*g*, respectively, resulting in gaps. Accordingly, the third distance H3 between the rear face 108R of the disk 108 and the lower end face 174 of the outer tube member 164 is set at the smallest first distance H31 (which is not shown and which is equal to the third distance H3).

When the first elongated protrusion 176*a*, the second elongated protrusion 176*b*, and the third elongated protrusion 176*c* are respectively fitted into the second, fifth and eighth receiving recess 180*b*, 180*e* and 180*h*, the lower ends of the first, second and third elongated protrusions 176*a*, 176*b* and 176*c* abut against the bottom faces of the second, fifth and eighth receiving recess 180*b*, 180*e* and 180*h*, respectively. Accordingly, the third distance H3 between the rear face 108R of the disk 108 and the lower end face 174 of the outer tube member 164 is set at the second distance H32 (which is not shown). The second distance H32 is slightly larger than the first distance H31.

When the first elongated protrusion 176*a*, the second elongated protrusion 176*b*, and the third elongated protrusion 176*c* are respectively fitted into the third, sixth and ninth receiving recess 180*c*, 180*f* and 180*i*, the lower ends of the first, second and third elongated protrusions 176*a*, 176*b* and 176*c* abut against the bottom faces of the third, sixth and ninth receiving recess 180*c*, 180*f* and 180*i*, respectively. Accordingly, the third distance H3 between the rear face 108R of the disk 108 and the lower end face 174 of the outer tube member 164 is set at the third distance H33 (which is not shown). The third distance H33 is slightly larger than the second distance H32.

In use, the inner tube member 152 and the outer tube member 164 are coupled together while the first, second and third elongated protrusions 176*a*, 176*b*, and 176*c* are respectively fitted into a corresponding one of the three groups of the first to ninth receiving recess 180*a* to 180*i*, resulting in the combination of the rotary disk 108 and the height adjusting mechanism 160. Then, this combination is mounted on the base 104 in such a way that the outer tube member 164 is dropped into a bearing hole 182 formed at the center of the disk receiving hole 126. For this reason, the outer surface of the outer tube member 164 and the inner surface 172 of the bearing hole 182 are rotatably fitted and as a result, the rotary disk 108 can be rotated stably around the rotation axis RA.

In this way, an annular coin or carrying path MP is formed between the outer surface of the inner tube member 162 and the coin guiding wall 130, as shown in FIG. 3.

Since the lower end face 174 of the outer tube member 164 is supported by the bottom face 185 of the bearing hole 182, the interval between the rear face 108R of the disk 108 and the bottom face 131 of the disk receiving hole 126 is determined by the first distanced D21, the second distance D22, or the third distance D23 which is defined by the combination of the inner tube member 152 and the outer tube member 164. Accordingly, the coins C dropped into the apertures 136 of the disk 108 are supported by surface contact of the surfaces or backs of the coins C with the base 104 and at the same time, the coins C are pressed and moved by the first pressing members 146A due to the rotation of the rotary disk 108, and guided by the coin guiding wall 130 of the disk receiving hole 126. In this way, the coins C are rotated along the coin path or carrying path MP in conjunction with the rotation of the disk 108.

In the event of a coin jam, the rotary disk 108 is rotated in the reverse direction. Due to this reverse rotation, the back faces 151A and 151B of the first pressing member 146A and the second pressing member 146B press the peripheral face of the coins C, thereby moving the coins C in an opposite direction to that of the forward rotation.

Since the guide pin 112 is moved to the non-guiding point NGP when the rotary disk 108 is rotated in the reverse direction, the guide pin 112 does not block the movement of the coins C along the carrying path MP. Therefore, the coins C are rotated in conjunction with the disk 108 in the reverse direction and the coin jam is eliminated due to the stirring action of the disk 108, resulting in preparation for restart.

[Dispensing Opening]

The dispensing opening 110 is an opening through which the coins C that have been moved along the carrying path MP can be moved radially from the disk receiving hole 126. As shown in FIG. 3, the dispensing opening 110 is formed by removing a part of the circular coin guiding wall 130.

As shown in FIG. 3, the dispensing opening 110 is an opening formed by removing a part of the coin guiding wall 130 of the base 104 (more specifically, an upper part of the inclined section of the base 104) in such a way as to have a size greater than the maximum coin diameter. Concretely speaking, the dispensing opening 110 is a slit-shaped sideways opening defined by an upstream-side edge 130*u* and a downstream-side edge 130*d* of the coin guiding wall 130. The interval between the upstream-side edge 130*u* and the downstream-side edge 130*d* is greater than the diameter of the maximum-diameter coin C and less than twice as much as the maximum-diameter coin C.

In this embodiment, the interval between the upstream- and downstream-side edges 130*u* and 130*d* is set at about 1.2 times as much as the diameter of the maximum-sized coin C.

[Dispensing Passage]

The dispensing passage 114 is extended linearly from the dispensing opening 110 along one radius of the disk receiving hole 126 and has the function of guiding the coins C ejected from the dispensing opening 110. In this embodiment, the dispensing passage 114, which is like a recess, is formed by a passage bottom face 186 formed on an extension of the plane on which the bottom face 131 of the disk receiving hole 126 is positioned, a downstream-side guiding face 187, and an upstream-side guiding face 189 of a dispensing opening adjustor 262 which will be described later.

However, the dispensing passage 114 does not need to be like a recess and may be formed by a flat face only. This means that the dispensing passage 114 may be formed by the passage bottom face 186 only. The end of the passage bottom face 186 constitutes a coin outlet 188.

In this embodiment, the length of the dispensing passage 114 is approximately as much as the radius of the coin C; however, this length may be greater or less than the radius of the coin C.

[Guide Pin]

Next, the guide pin or guide member 112 will be explained below with reference to FIGS. 9 to 11.

The guide pin 112 has the function of guiding the coins C which are moved along the carrying path MP in conjunction with the rotation of the rotary disk 108 by the pressing operation of the pressing members 146 on the disk 108 toward a radial direction of the disk 108, in other words, a radial direction of the disk receiving hole 126. This function is a basic function and termed the "radial guiding function".

In this embodiment, as an auxiliary function, the guide pin 112 has the function of allowing the coins C to be moved in the reverse direction along the carrying path MP in the case where the rotary disk 108 is rotated in the reverse direction for solving a coin jam and in the case where the coins C pressed by the pressing members 146 are moved in the reverse direction along the carrying path MP. This function is termed the "reversal permitting function". However, this function is not an essential function for the present invention.

Moreover, the guide pin 112 in this embodiment has the further function of selectively guiding the coins C or not, as another basic function. This function is termed the "selective guiding function".

Furthermore, the guide pin 112 in this embodiment has the function of ejecting the coins C to the dispensing passage 114, as another auxiliary function. This function is termed the "ejecting function". However, this function may be carried out by any type of ejecting devices provided in addition to the guide pin 112.

In this embodiment, the guide pin 112 is configured to carry out the aforementioned four functions; however, the present invention is not limited to this. These four functions may be carried out separately, in other words, each of these four functions may be carried out by a single device. Two or three of these functions may be carried out by a single device.

In this embodiment, the guide pin 112 is selectively positioned at a guiding position GP (see FIGS. 15A and 15B) or a non-guiding position NGP (see FIGS. 16A and 16B) by a position selecting device 190, thereby performing the selective guiding function.

If the guide pin 112 is positioned at the guiding position GP, it performs the radial guiding function for guiding the coins C to a radial direction of the rotary disk 108. The guide pin 112 constitutes the ejecting device 116 in cooperation with a resilience device 192 and a dispensing opening adjustor 262 which will be described later. This means that the guide pin 112 performs its ejecting function in this way.

The guide pin 112 will be explained in more detail below with reference to FIGS. 9 to 11.

Basically, the guide pin 112 has the selective guiding function that guides the coins C moved in conjunction with the rotation of the rotary disk 108. In this embodiment, however, the guide pin 112 has the ejecting function also. In this embodiment, the guide pin 112 is a bar-shaped member whose side view is linear. The lower end of the guide pin 112 is rockably supported by a supporting shaft 194 and the upper end thereof is formed to be like a two-pronged fork. Therefore, it may be said that the guide pin 112 comprises a first guide pin portion 112A and a second guide pin portion 112B, which constitute a shape like a two-pronged fork. The first guide pin portion 112A and the second guide pin portion 112B are arranged in such a way as to be respectively overlapped with the arc-shaped first clearance grooves 150A and the arc-shaped second clearance grooves 150B.

It is needless to say that the number of the guide pin 112 may be one or three or more as long as it performs the radial guiding function.

On the top ends of the first guide pin portion 112A and the second guide pin portion 112B, a first inclined face 196A and a second inclined face 196B are respectively formed in such a way as to be inclined at 45 degrees with respect to the horizontal plane in the state where the first and second guide pin portions 112A and 112B stand upright. Just before ejecting the coins C, the first and second guide pin portions 112A and 112B are inclined until the angle between the portions 112A and 112B and the horizontal plane is about 60 degrees.

The both ends of the supporting shaft 194 are fixed to a position selector 198 that constitutes the position selecting device 190.

The guide pin 112 is moved to the guiding position GP through an advance/retreat hole 129 formed at a position opposed to the carrying path MP of the base 104 and furthermore, moved to the non-guiding position NGP from the guiding position GP. In this embodiment, as the advance/retreat hole 129, a first advance/retreat hole 129A and a second advance/retreat hole 129B are provided, which are slit-shaped and opposed to the first and second guide pin portions 112A and 112B, respectively.

[Position Selecting Device]

The position selecting device 190 has the function of moving selectively the guide pin 112 to the guiding position GP or the non-guiding position NGP. Accordingly, the position selecting device 190 may be replaced with other device having a similar function.

Figure 9:
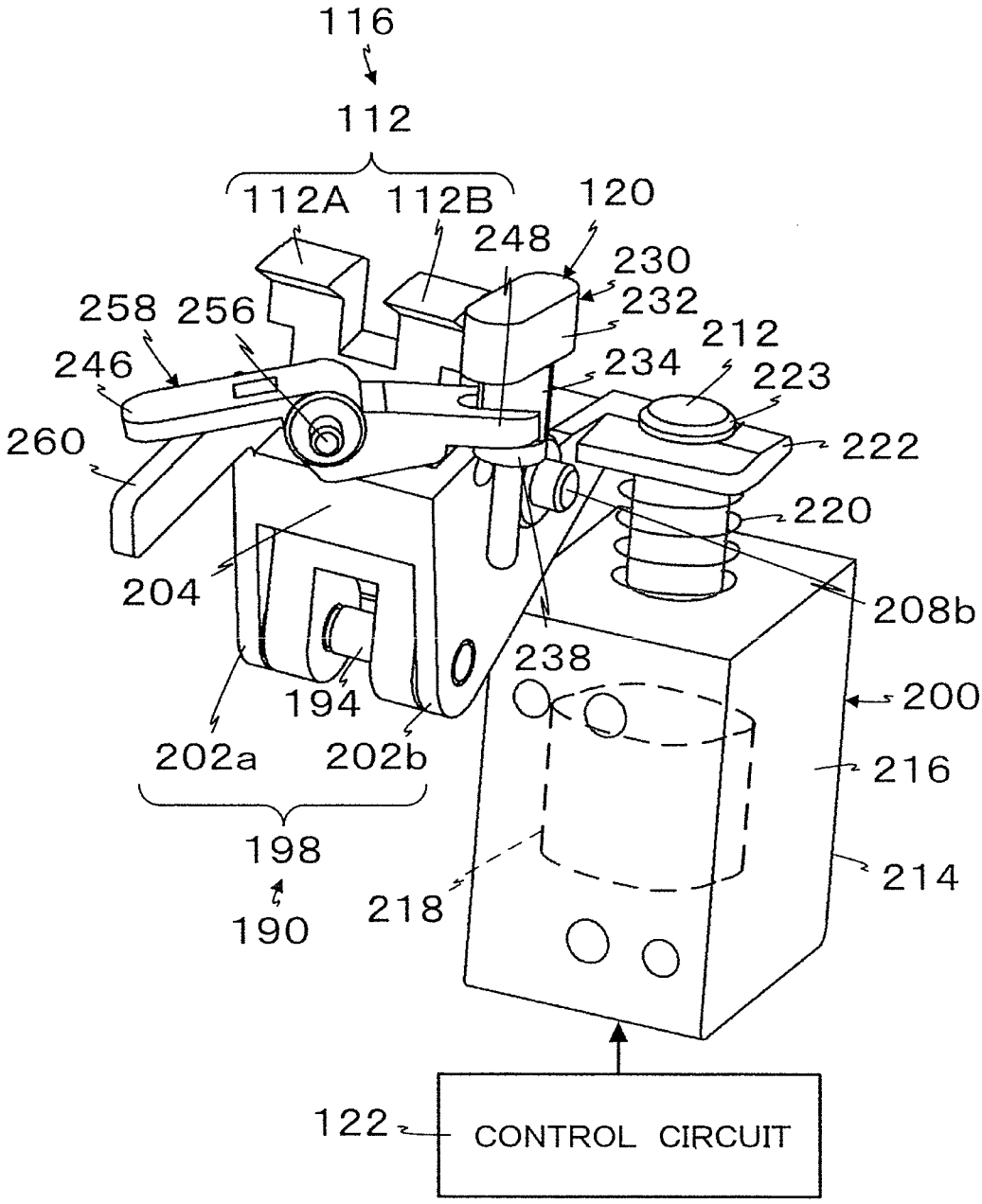
FIG. 9 is a perspective view of the guide pin, the stopper, and their interlocking device used in the coin dispensing apparatus according to the first embodiment of the present invention, which is seen from the side of the stopper.
Figure 10:
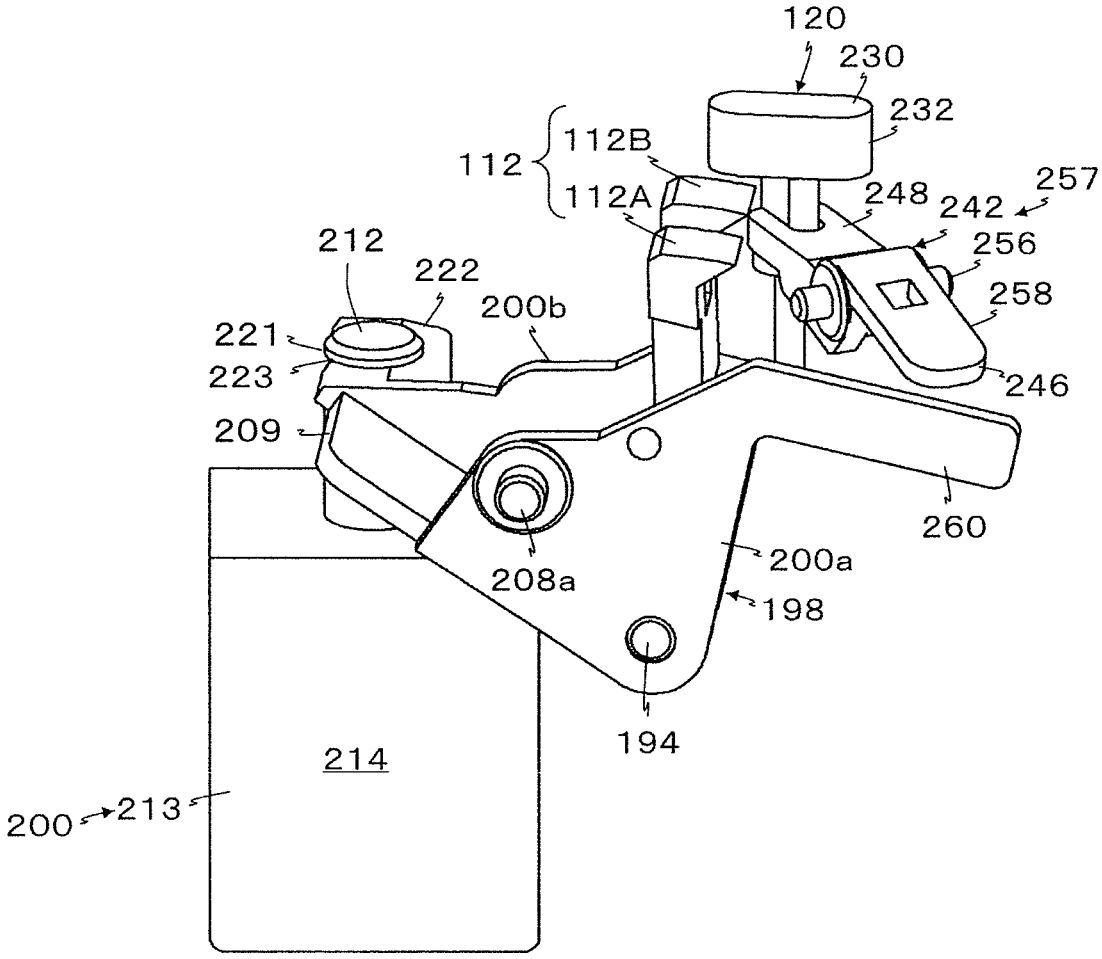
FIG. 10 is a perspective view of the guide pin, the stopper, and their interlocking device used in the coin dispensing apparatus according to the first embodiment of the present invention, which is seen from the side of the guide pin.

In this embodiment, the position selecting device 190 comprises the position selector 198 and an actuator 200, as shown in FIGS. 9 and 10.

The position selector 198 constituting the position selecting device 190 has the function of selectively positioning the guide pin 112 between the guiding position GP and the non-guiding position NGP. Concretely, when the position selector 198 is positioned at a dispensing assisting position AP (FIG. 15B), the selector 198 makes the guide pin 112 positioned at the guiding position GP. When the position selector 198 is positioned at a non-dispensing assisting position NAP (FIG. 16B), the selector 198 makes the guide pin 112 positioned at the non-guiding position NGP.

Figure 15A:
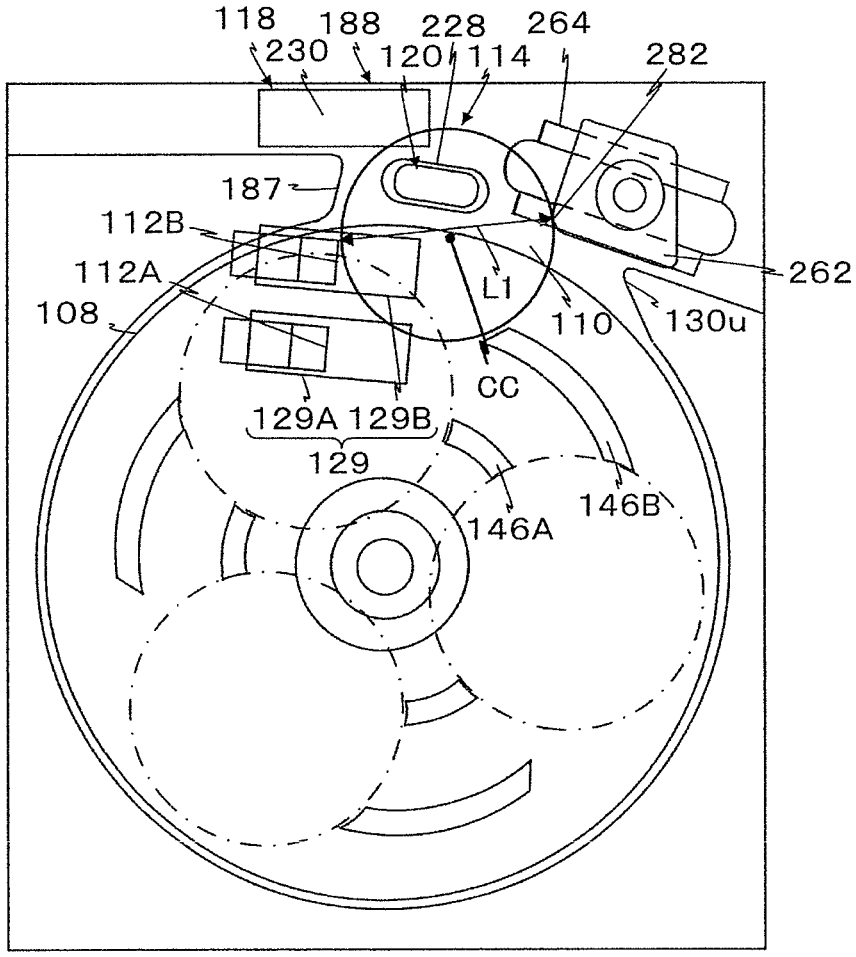
FIG. 15A is a plan view showing the operation of the coin dispensing apparatus according to the first embodiment of the present invention in the non-dispensing period.
Figure 15B:
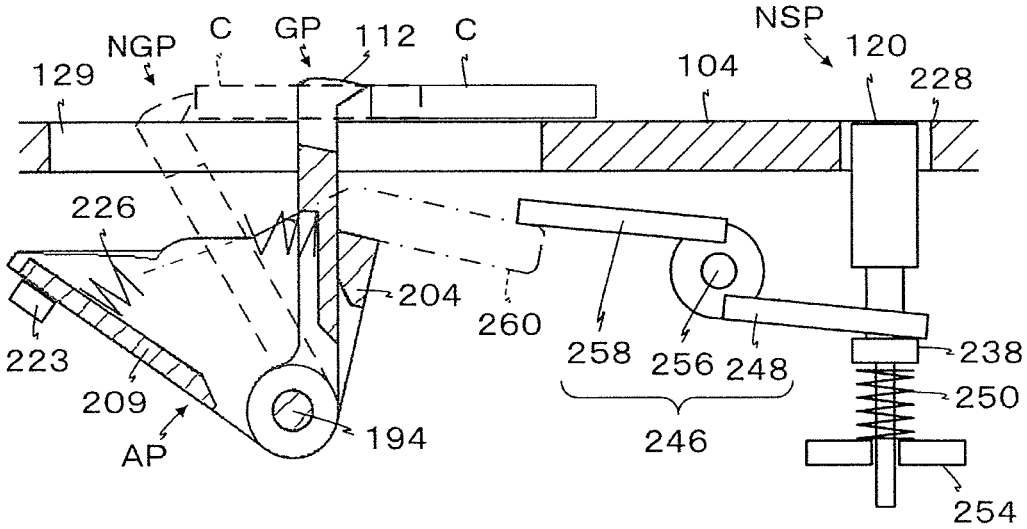
FIG. 15B is a cross-sectional view showing the operation of the coin dispensing apparatus according to the first embodiment of the present invention in the non-dispensing period.
Figure 16A:
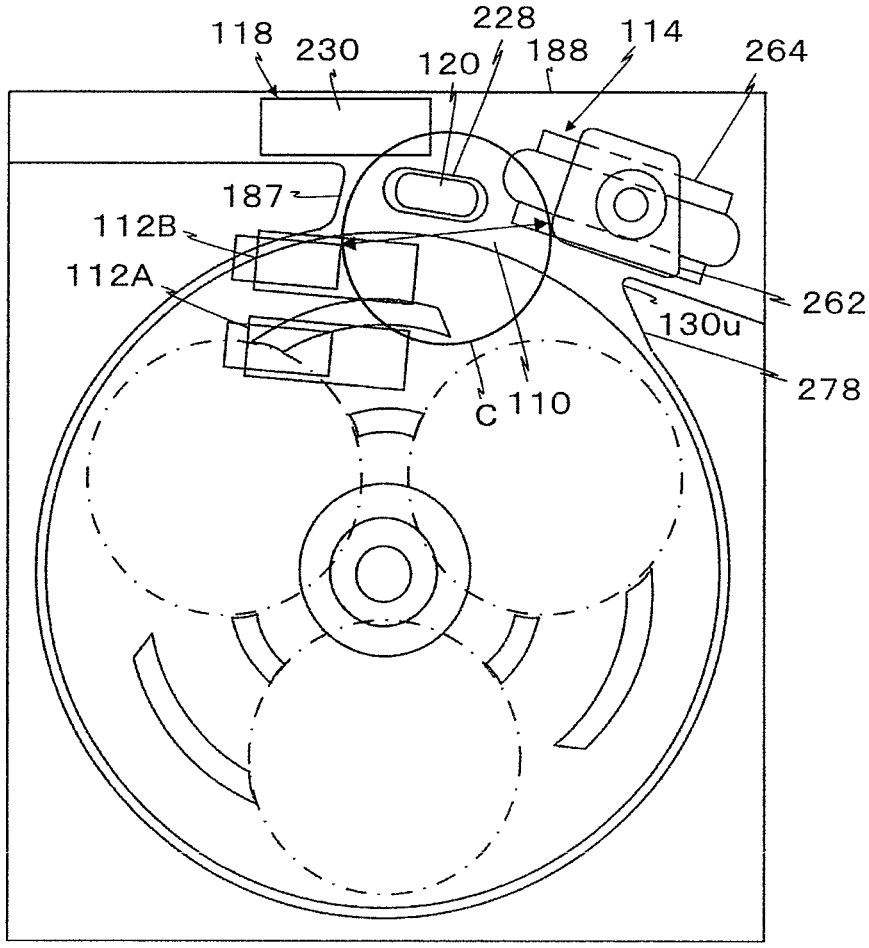
FIG. 16A is a plan view showing the operation of the coin dispensing apparatus according to the first embodiment of the present invention in the dispensing period.
Figure 16B:
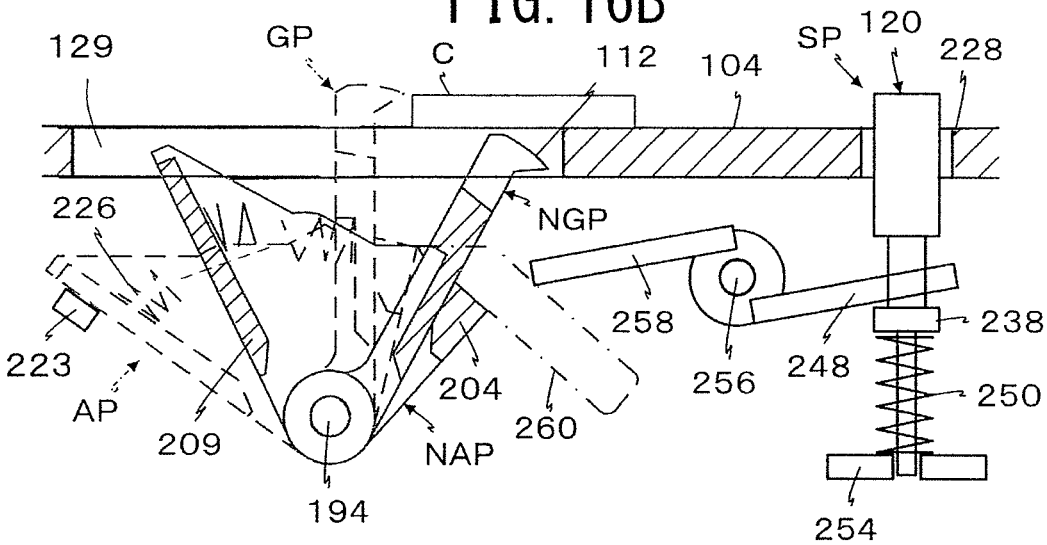
FIG. 16B is a cross-sectional view showing the operation of the coin dispensing apparatus according to the first embodiment of the present invention in the dispensing period.

In this embodiment, the position selector 198 comprises a pair of a first sidewall 202*a* and a second sidewall 202*b* the side view of which are inverted triangular and which are arranged in parallel at a predetermined distance in a vertical direction, a rocking motion limiter 204 that interconnects the first sidewall 202*a* and the second sidewall 202*b*, and a spring receiver 209, as shown in FIGS. 15B and 16B. The overall shape of the position selector 198 is like a hollow bag.

A large part of the guide pin 112 is placed closely between the first sidewall 202*a* and the second sidewall 202*b*, and the movement of the guide pin 112 along the supporting shaft 194 is limited.

On the upper ends of the first and second sidewalls 202*a* and 202*b*, a first rocking shaft 208*a* and a second rocking shaft 208*b* are respectively formed to protrude from their middle portions along the same axis in opposite directions. The first and second rocking shafts 208*a* and 208*b* are rockably supported by a first bracket 219*a* and a second bracket 219*b*, respectively. The first bracket 219*a* and the second bracket 219*b* are located parallel to each other at a predetermined interval and are protruded downward from the back of the base 104.

Moreover, in the vicinity of the spring receiver 209 formed at the upper end of the second sidewall 202*b*, an attachment piece 222 having an engaging groove 221 is formed to protrude laterally from there.

The dispensing assisting position AP for the position selector 198 is limited by a position limiter 223 that may be engaged with a part of the position selector 198. The position limiter 223 is a member fixed on the lower surface of the base 104. When the position selector 198 is rocked to the dispensing assisting position AP by the actuator 200 which will be described later, the position limiter 223 is engaged with a part of the position selector 198, thereby stopping a further rocking motion of the position selector 198. In this way, the position selector 198 is kept at the dispensing assisting position AP.

The rocking motion limiter 204 is a bar-shaped member formed laterally in such a way as to interconnect the first and second sidewalls 202*a* and 202*b* at their upper ends. When the guide pin 112 receives a rocking force from an ejecting spring 225, the rocking motion limiter 204 is engaged with the guide pin 112 which has been rocked in a predetermined direction by this rocking force, thereby limiting the relative rocking motion of the guide pin 112 with respect to the rocking motion limiter 204.

As seen from FIGS. 15A and 15B, the rocking motion limiter 204 has a trapezoidal cross section. The rocking motion limiter 204 is configured in such a way as to be in surface contact with the guide pin 112 when the limiter 204 is engaged with the guide pin 112.

The spring receiver 209 has the function of supporting fixedly one end of the ejecting spring 226 which gives a rocking force to the guide pin 112. The spring receiver 209 is formed by a plate-shaped member that interconnects the first and second sidewalls 202*a* and 202*b* on the opposite side of the rocking motion limiter 204. The spring receiver 209 receives one end of the spring 226 stably at a flat surface of the receiver 209. The end of the spring 226 is fixed on this surface by an engaging member (not shown).

The attachment piece 222 is formed to be integrated with the position selector 198. The attachment piece 222 is a plate-shaped member that protrudes outward laterally from the side of the spring receiver 209 formed at the upper end of the second sidewall 202*b*. The attachment piece 222 has a grove 221 in which a part of the output rod 212 of an actuator 200 which will be described later is fitted and engaged.

The distance between the first and second rocking shafts 208*a* and 208*b* and the attachment piece 222 is shorter than the distance between the first and second rocking shafts 208*a* and 208*b* and a linking portion 260 explained later. This is because the actuator 200 which can be placed in a small-sized coin dispensing apparatus needs to be used.

The position selector 198 further comprises the linking portion 260. The linking portion 260 has the function of moving a rocking lever 257 which serves as an interlocking device 242 described later. In this embodiment, the linking portion 260 is positioned at the upper end of the first sidewall 202*a* and is a linear bar-shaped one that protrudes laterally from the vicinity of the rocking motion limiter 204. When the position selector 198 is positioned at the non-dispensing assisting position NAP, the linking portion 260 is moved to a position where the linking portion 260 does not move a driven lever 258 which will be described later. When the position selector 198 is positioned at the dispensing assisting position AP, the linking portion 260 is moved to a position where the linking portion 260 moves the driven lever 258.

The actuator 200 constituting a part of the position selecting device 190 has the function of selectively positioning the position selector 198 at the dispensing assisting position AP or the non-dispensing assisting position NAP based on an instruction from the control circuit 122. This means that the actuator 200 advances or retreats (or pushes out or pulls in) the output rod 212 based on an instruction from the control circuit 122, thereby positioning selectively the position selector 198 at the dispensing assisting position AP or the non-dispensing assisting position NAP. Accordingly, an electric actuator, a mechanical actuator or a fluidic actuator may be used as the actuator 200.

In this embodiment, an electric actuator 213 is used as the actuator 200. The electric actuator 213 is a general term of actuators that provide or cause mechanical displacements by supplying currents, which includes the type where Joule heat is generated by supplying currents and the deformation amount of a shape-memory alloy is varied by using this heat and the type of linear motors.

In this embodiment, an electromagnetic actuator 214 is used as the electric actuator 213. The electromagnetic actuator 214 comprises a rectangular pillar-shaped body 216, an electromagnet 218 placed in the body 216, and the output rod 212 mounted in the body 216 as a movable core. When the electromagnet 218 is magnetized, the output rod 212 is pulled into the body 216. When the electromagnet 218 is de-magnetized, the output rod 212 is pushed out from the body 216 by the action of a spring 220 mounted on the outside of the rod 212 like a sheath.

On the top end of the output rod 212 of the electromagnetic actuator 214, a large diameter part 223 is formed. A small diameter part is formed below the large diameter part 223, with which the groove 221 for the attachment piece 222 is engaged. The attachment piece 222 is pressed against the lower face of the large diameter part 223 by the spring 220. Therefore, if the electromagnet 218 is magnetized, the output rod 212 is lowered or pulled in and thus, the position selector 198 is rocked counterclockwise in FIG. 10 to the dispensing assisting position AP by way of the large diameter part 23 and the attachment piece 222. As a result, the guide pin 112 is positioned at the guiding position GP. If the electromagnet 218 is de-magnetized, the output rod 212 is raised or pushed out from the body 216 and thus, the position selector 198 is rocked clockwise in FIG. 10 to the non-dispensing assisting position NAP. As a result, the guide pin 112 is positioned at the non-guiding position NGP.

If the guide pin 112 is positioned at the non-guiding position NGP, the movement of the coins C along the carrying path MP is not prevented. Thus, the guide pin 112 performs the reversal permitting function also in the event that the guide pin 112 is positioned at the non-guiding position NGP.

[Ejecting Device]

Next, the ejecting device 116 will be explained below.

The ejecting device 116 has the function of ejecting the coins C guided by the guide pin 112 to the dispensing opening 110 to the dispensing passage 114. This means that the ejecting device 116 has the "ejecting function". In this embodiment, the ejecting device 116 comprises the guide pin 112, the resilience device 192, and the dispensing opening adjustor 262.

Since the guide pin 112 is already explained as above, the resilience device 192 will be explained here with reference to FIG. 11.

The resilience device 192 elastically biases the guide pin 112 toward the side of the rocking motion limiter 204 of the position selector 198. When the guide pin 112 is pressed by the coins C to be rocked around the supporting shaft 194, thereby accumulating a resilience force in the resilience device 192, the resilience force thus accumulated will cause the guide pin 112 to rock around the shaft 194 in the reverse direction, thereby ejecting the coins C.

In this embodiment, the resilience device 192 is a resilient spring 226 as an elastic member 224 which is placed between the spring receiver 209 and the guide pin 112. Therefore, if the coin C presses the first and second inclined faces 196A and 196B of the first and second guide pin portions 112A and 112B and as a result, the first and second guide pin portions 112A and 112B are rocked around the supporting shaft 194, a resilience force is accumulated in the resilient spring 226. If the pressing motion to the guide pin portions 112A and 112B by the coin C is eliminated at a predetermined moment, the guide pin portions 112A and 112B will be rocked lively in the reverse direction due to the resilience force accumulated in the resilient spring 226. Because of this reverse rocking motion, the first and second inclined faces 196A and 196B (more specifically, the first inclined face 196A) will eject the coin C to the dispensing passage 114.

[Coin Sensor]

As shown in FIG. 3, the coin sensor 118 has the function of detecting the coin C ejected by the ejecting device 116. In this embodiment, a magnet-type metal sensor 230 is used as the coin sensor 118. Therefore, the coin sensor 118 may be replaced with other device having a similar function, such as a photoelectric sensor, a mechanical sensor or the like. In this embodiment, the coin sensor 118 is located to be opposite to the dispensing passage 114; however, the coin sensor 118 may be located in the downstream side of the coin outlet 188.

[Stopper]

Next, the stopper 120 will be explained in detail below with reference to FIGS. 3 to 11.

When the guide pin 112 is located at the non-guiding position NGP, the stopper 120 is located at the blocking position SP, thereby blocking the coin C which is moved in conjunction with the rotation of the rotary disk 108 not be moved to the dispensing passage 114 from the dispensing opening 110. When the guide pin 112 is located at the guiding position GP, the stopper 120 is located at the non-blocking position NSP, thereby allowing the coin C to be moved to the dispensing passage 114 from the dispensing opening 110.

In this embodiment, the stopper 120 is movably inserted into an appearance/disappearance hole 228 formed in the passage bottom face 186 of the dispensing passage 114 which is adjacent to the dispensing opening 110. The stopper 120 can be moved perpendicular to the passage bottom face 186.

At the blocking position SP, the stopper 120 is protruded from the appearance/disappearance hole 228 to the dispensing passage 114, thereby blocking the movement of the coin C through the dispensing passage 114. At the non-blocking position NSP, the stopper 120 is retracted from the dispensing passage 114 through the appearance/disappearance hole 228 (in other words, retracted to the downside of the dispensing passage 114), allowing the movement of the coin C through the dispensing passage 114.

In this embodiment, the appearance/disappearance hole 228 has a shape of an elongated rectangle whose corners are rounded. The length of the hole 228 is set so as to cover about one-third (⅓) of the length of the dispensing opening 110. However, the size and shape of the stopper 120 are not limited to these as far as the aforementioned functions can be realized.

Figure 11:
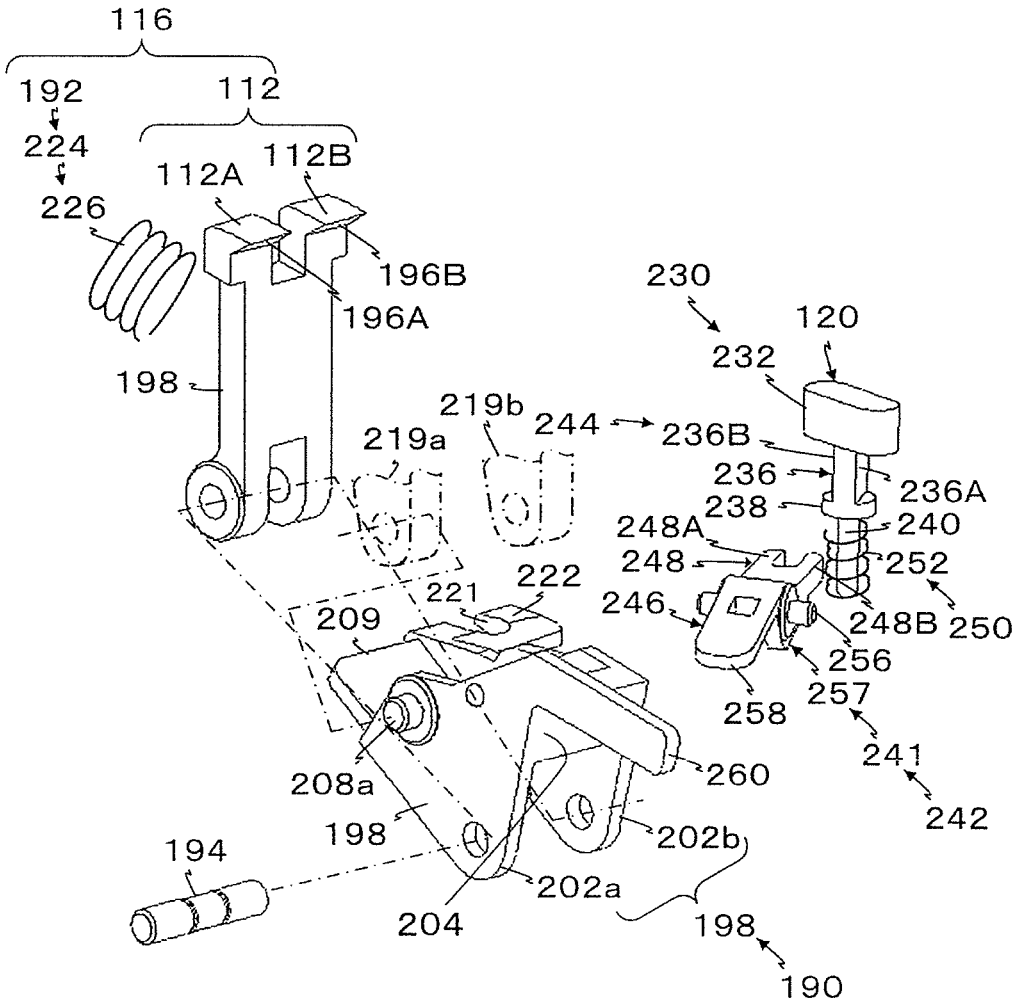
FIG. 11 is an exploded perspective view of the guide pin, the stopper, and their interlocking device used in the coin dispensing apparatus according to the first embodiment of the present invention.

In this embodiment, the stopper 120 is a bar-shaped member extending perpendicular to the passage bottom face 186, which comprises a stopper part 232 formed at the top end part 230, a cooperation part 236 extended downward from the top end part 230, a retainer part 238 located below the cooperation part 236, and a small diameter part 240 formed next to the retainer part 238, as shown in FIGS. 9 to 11.

The side face of the stopper part 232 (the top end part 230) of the stopper 120 has the function of making contact with the coin C to block its movement toward the dispensing passage 114. The stopper part 232 has a similar shape to the appearance/disappearance hole 228 in a plan view, which is slightly smaller than that of the hole 228. The thickness of the stopper part 232 is larger than the thickness of the base 104 in such a way that the stopper part 232 is guided by the inner wall face of the appearance/disappearance hole 228 to produce a linear reciprocating motion of the stopper 120 along its longitudinal axis. However, the present invention is not limited to this. If the stopper 120 can produce a linear reciprocating motion along the longitudinal axis thereof by cooperating with other part(s) or member(s), the thickness of the stopper part 232 may be smaller than the thickness of the base 104. The shape of the stopper 120 also is not limited to this. The stopper 120 may have any other shape like a circular bar, a polygonal pillar, or a triangular pillar.

The cooperation part 236 of the stopper 120 has the function of moving the stopper 120 to the non-blocking position NSP or the blocking position SP in interlocking with the movement of the guide pin 112 to the guiding position GP or non-guiding position NGP. In other words, the cooperation part 236 has the function of carrying the movement of the interlocking device 242 which will be described later to the stopper 120 to move the stopper 120 to the non-blocking position NSP or the blocking position SP in interlocking with the movement of the position selector 198 to the dispensing assisting position AP or the non-dispensing assisting position NAP.

In this embodiment, the cooperation part 236 is formed by a guiding part 244 comprising a first face 236A and a second face 236B formed in parallel to each other at a predetermined interval.

The guiding part 244 serving as the cooperation part 236 is sandwiched by a U-shaped part 248 like the legs of a frog of an interlocking member 246 described later. In other words, the first face 236A and the second face 236B of the guiding part 244 (the cooperation part 236) are respectively opposed to a first pinching portion 248A and a second pinching 248B formed in parallel to each other at a predetermined interval which constitute the U-shaped part 248.

Around the small diameter part 240 of the stopper 120, a spring 252 as a biasing member 250 is mounted. The upper end of the spring 252 is abutted on the lower face of the retainer part 238 of the stopper 120, and the lower end thereof is abutted on a bracket 254 (see FIG. 15B) which is formed on the back of the base 104 to be integrated therewith. Therefore, the stopper 120 is biased upward with respect to the base 104 by the resilience force of the spring 252. In other words, the stopper 120 is biased in such a way as to be protruded upward from the passage bottom face 186 of the dispensing passage 114. However, the amount of protrusion of the stopper 120 is determined by abutting the retainer part 238 on the interlocking member 246. In addition, due to the downward motion of the retainer portion 238 caused by rocking the interlocking member 246, the stopper 120 (the top end part 230) is pulled into the appearance/disappearance hole 228 until at least the top end face of the stopper 120 reaches the same level as the passage bottom face 186

[Interlocking Device]

Next, the interlocking device 242 will be explained below with reference to FIGS. 10 and 11.

The interlocking device 242 has the function of interlocking the guide pin 112 and the stopper 120. In other words, the interlocking device 242 places the stopper 120 at the non-blocking position NSP if the guide pin 112 is located at the guiding position GP, and places the stopper 120 at the blocking position SP if the guide pin 112 is located at the non-guiding position NGP.

In this embodiment, a mechanical linking mechanism 241 is used as the interlocking device 242. More specifically, the mechanical linking mechanism 241 is formed by the rocking lever 257 as the plate-shaped interlocking member 246.

At one end of the interlocking member 246 constituting the interlocking device 242 (the mechanical linking mechanism 241), the U-shaped part 248 is formed. The U-shaped part 248 is used to sandwich the cooperation part 236 of the stopper 120 at the first face 236A and the second face 236B thereof. By this structure, when the interlocking member 246 is rocked clockwise in FIG. 9, the retainer portion 238 of the stopper 120 is pressed down by the U-shaped part 248. So, the stopper 120 is pressed down into the appearance/disappearance hole 228 to reach the non-blocking position NSP. At the other end of the interlocking member 246, a driven lever 258 is formed to extend linearly to have a predetermined length.

In this embodiment, in response to the movement of the position selector 198 to the non-guiding position NGP, the pushing up action to the driven lever 258 is eliminated and as a result, the stopper 120 is pushed upward by the spring 252 as the biasing member 250 to be moved to the blocking position SP. If the position selector 198 is moved to the dispensing assisting position AP, the stopper 120 is moved downward against the resilience of the spring 252 and stopped at the blocking position SP defined in the dispensing passage 114 while protruding the stopper part 232 of the stopper 120 from the passage bottom face 186. In other words, if the electromagnet 218 of the electromagnetic actuator 214 is de-magnetized, the position selector 198 is located at the non-dispensing assisting position NAP and therefore, the linking portion 260 does not press the driven lever 258 from the downside. As a result, the stopper 120 is pushed upward by the resilience force of the spring 252 and moved until the retainer part 238 is prevented from moving by the U-shaped part 248. In other words, the stopper 120 is pushed upward and the top end part 230 of the stopper 120 is protruded from the passage bottom face 186, thereby placing the stopper 120 at the blocking position SP where the stopper part 232 crosses the dispensing passage 114. At that time, the position selector 198 is engaged by the position limiter 223.

If the electromagnet 218 is magnetized, the output rod 212 is pulled downward in FIG. 10 and therefore, the position selector 198 is rocked counterclockwise in FIG. 10 around the supporting shaft 194 to reach the dispensing assisting position AP. Consequently, the linking portion 260 pushes the driven lever 258 upward from the downside and the driven lever 258 (and therefore, the U-shaped part 248) pushes the retainer part 238 downward against the resilience of the spring 252. In this way, the stopper part 232 is pulled into the appearance/disappearance hole 228 and retracted from the dispensing passage 114, reaching the non-blocking position NSP.

In this embodiment, as seen from FIG. 9, the linking portion 260 and the interlocking member 246 are arranged so as to form an acute angle in a plan view. Because of this arrangement and structure, there is an advantage that the guide pin 112 and the stopper 120 can be interlocked with each other even in the small-sized coin dispensing apparatus 100 and that the coin dispensing apparatus 100 can be configured at a low cost.

[Dispensing Opening Adjustor]

Figure 12:
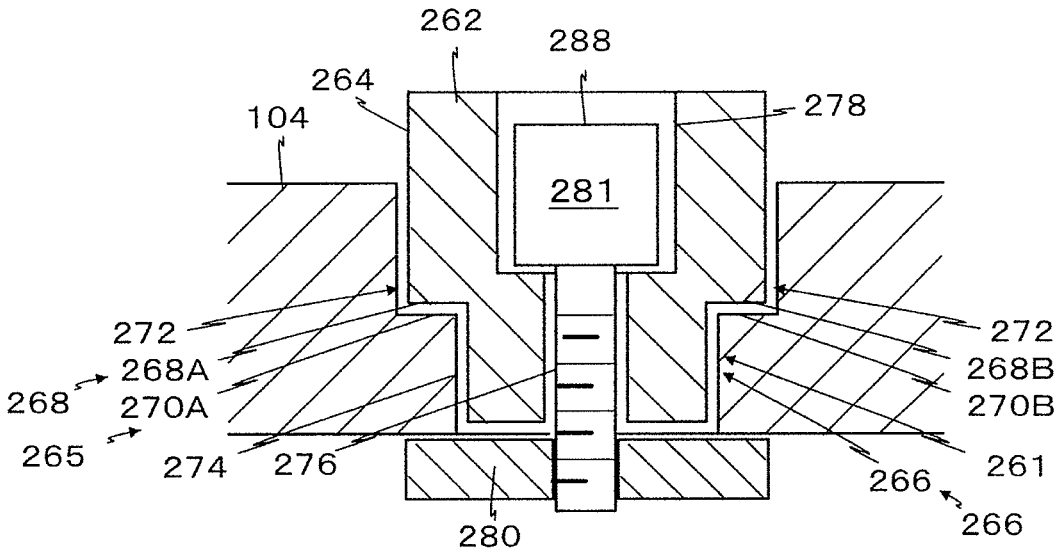
FIG. 12 is a cross-sectional view along the line XII-XII in FIG. 3.

Next, the dispensing opening adjustor 262 that constitutes a part of the ejecting device 116 will be explained below with reference to FIGS. 3 and 12.

The dispensing opening adjustor 262 has the function of adjusting the interval DT between the downstream-side guiding face 187 and the dispensing opening adjustor 262 in accordance with the diameter of the coin C to define the outlet of the coin C. In this embodiment, the dispensing opening adjustor 262 further has the function of dispensing the coin C as a part of the ejecting device 116 also. This means that the dispensing opening adjustor 262 sandwiches the coin C in cooperation with the guide pin 112 (specifically, the second guide pin portion 112B) and finally, the second guide pin portion 112B ejects the coin C.

In this embodiment, the dispensing opening adjustor 262 is trapezoidal plate-shaped in a plan view. As seen from FIG. 12 showing the longitudinal cross section of the dispensing opening adjustor 262, the adjustor 262 comprises an upper part 264 and a lower part 266, where the upper part 264 is wider than the lower part 266. A boundary face 268A and a boundary face 268B are formed between the upper and lower parts 264 and 266, respectively. Thus, the dispensing opening adjustor 262 has a stepped exterior.

On the passage bottom face 186 of the dispensing passage 114, as shown in FIG. 3, a position adjusting groove 270 is formed. The position adjusting groove 270 is linearly extended toward the downstream-side edge 130*d* from the upstream-side edge 130*u* and reaches the center of the dispensing passage 114. The longitudinal cross section of the position adjusting groove 270 comprises a relatively wider upper groove 272 and a relatively narrower lower groove 274, where a boundary face 270A and a boundary face 270B are formed between the upper and lower grooves 272 and 274. Thus, the position adjusting groove 270 forms a stepped hole.

The dispensing opening adjustor 262 is inserted into the position adjusting groove 270. Specifically, the lower and upper parts 266 and 264 of the dispensing opening adjustor 262 are slidably inserted closely in the lower and upper grooves 274 and 272 of the position adjusting groove 270, respectively. In other words, the dispensing opening adjustor 262 is extended linearly along the position adjusting groove 270 and can be contacted with the downstream-side guiding face 187.

At the central part of the dispensing opening adjustor 262, a penetrating threaded hole 276 is formed vertically. The top of the dispensing opening adjustor 262 is cylindrically depressed. This is to allow the head 281 of a fixing screw 288 to be buried in this depression. If the fixing screw 288 is penetrated through the threaded hole 276 of the adjustor 262, and a nut 280 which is abutted onto the back of the base 104 is thrust into the end of the screw 288, thereby sandwiching the base 104 (the boundary faces 270A and 270B) by the nut 280 and the dispensing opening adjustor 262. Thus, the dispensing opening adjustor 262 can be fixed on the base 104 at a suitable position in accordance with the diameter of the coin C. The distance between a coin engaging part 282 of the dispensing opening adjustor 262 and the downstream-side edge 130*d* of the coin guiding wall 130 is set to be slightly larger than the diameter of the coin C. The coin engaging part 282 is formed at a corner of the adjustor 262.

As shown in FIGS. 15A and 15B, in the event that the coin C is sandwiched by the guide pin portion 112B and the coin engaging part 282, unless the guide pin 112 is rocked around the supporting shaft 194 by a predetermined amount or more, the center CC of the coin C does not pass through the first line L1 that connects the contact point of the second guide pin portion 112B and the coin C and the contact point of the coin C and the coin engaging part 282. The positional relationship among the guide pin portion 112B, the coin engaging part 282, and the supporting shaft 194 is determined in this way. This means that the coin C can be ejected as long as the resilience force of the resilience spring 226 that is applied to the guide pin 112 is equal to a predetermined value or greater. Because of such the relationship, there is an advantage that dispensing errors of the coin C can be prevented from occurring.

Figure 17:
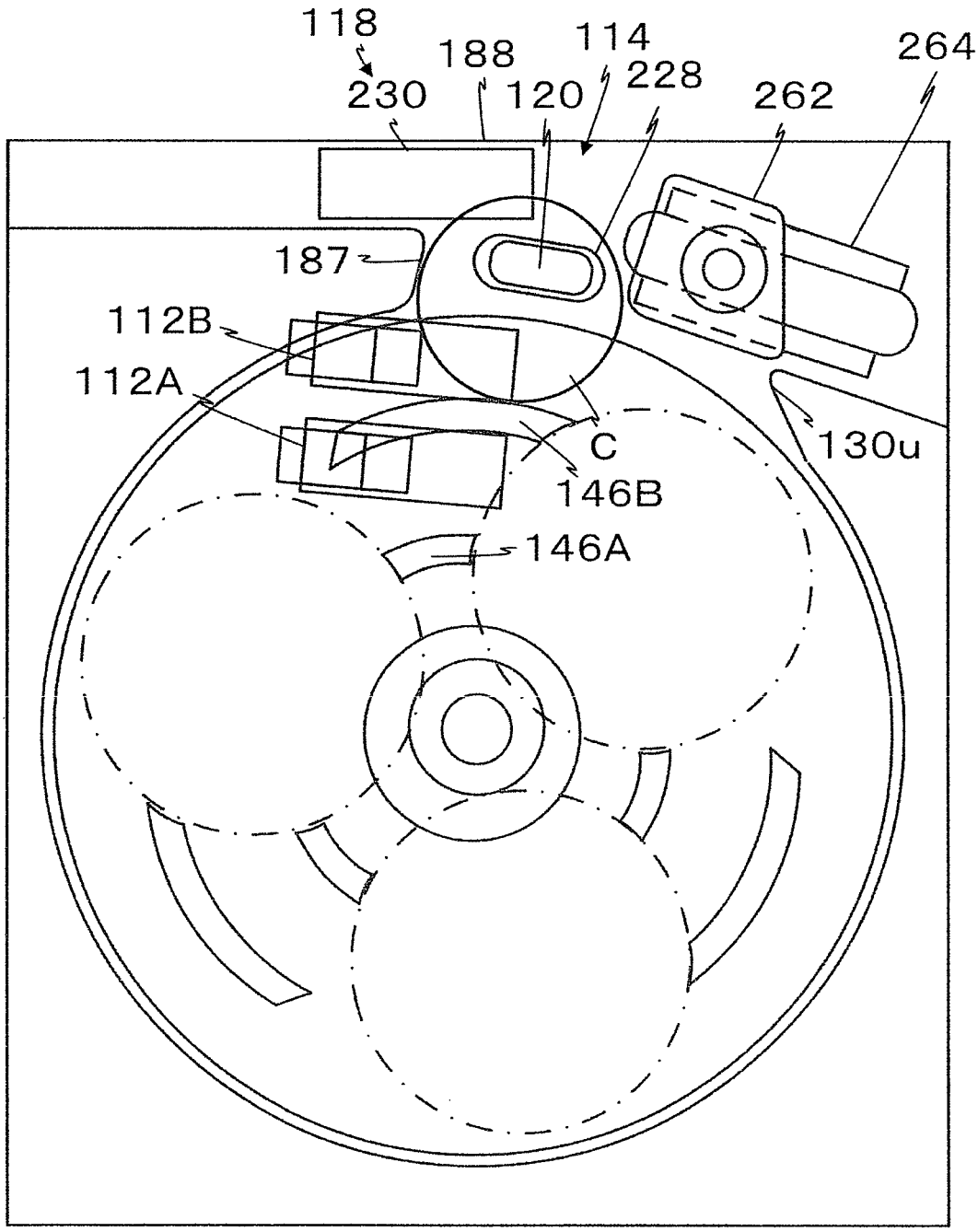
FIG. 17 is a plan view showing the operation of the coin dispensing apparatus according to the first embodiment of the present invention, where small-sized coins are dispensed.
Figure 18A:
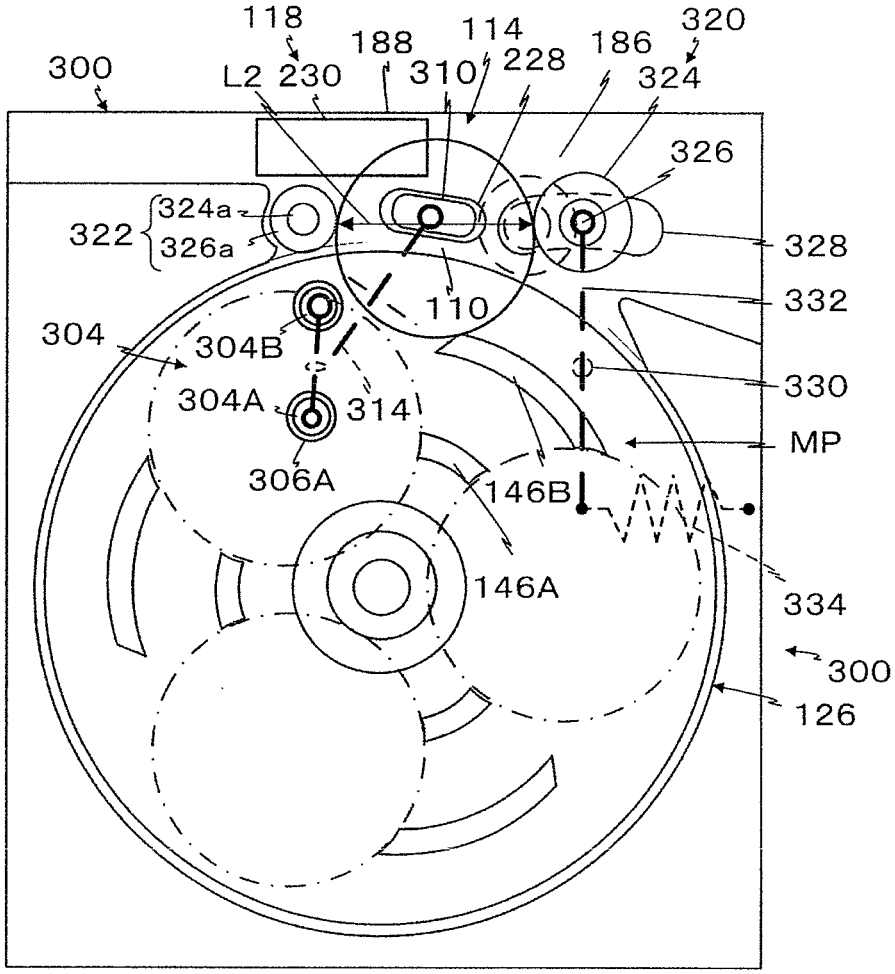
FIG. 18A is a plan view showing the operation of a coin dispensing apparatus according to a second embodiment of the present invention in the non-dispensing period.
Figure 18B:
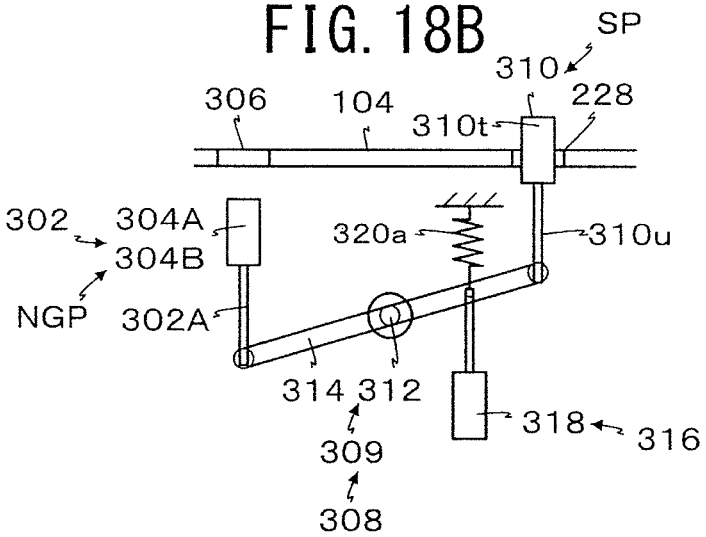
FIG. 18B is a cross-sectional view showing the cooperation of the guide pin and the stopper used in the coin dispensing apparatus according to the second embodiment of the present invention in the non-dispensing period.

If the position of the dispensing opening adjustor 262 is adjusted to a position corresponding to the coin C having the minimum diameter, as shown in FIG. 17, the dispensing opening adjustor 262 is located at a position close to the stopper 120. If the position of the dispensing opening adjustor 262 is adjusted to a position corresponding to the coin C having the maximum diameter, the dispensing opening adjustor 262 is located at a position shown in FIG. 3. Even in the latter case, the interval between the stopper 120 and the dispensing opening adjustor 262 is set to be smaller than the diameter of the minimum-sized coin C. This is to prevent a plurality of coins C from being dispensed simultaneously even if the minimum-sized coins C are supplied to the coin dispensing apparatus 100.

[Control Circuit]

Figure 13:
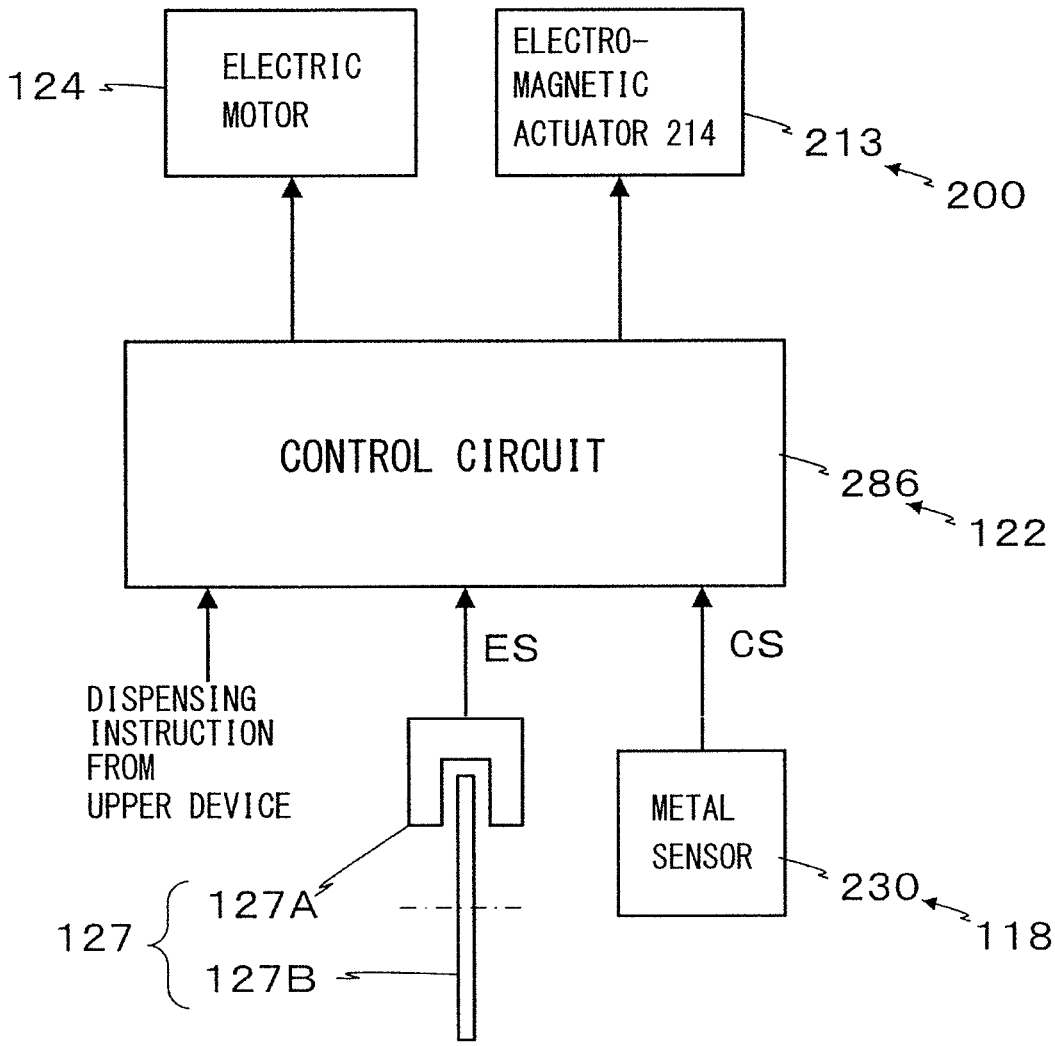
FIG. 13 is a functional block diagram of the controller (the control device) used in the coin dispensing apparatus according to the first embodiment of the present invention.
Figure 14:
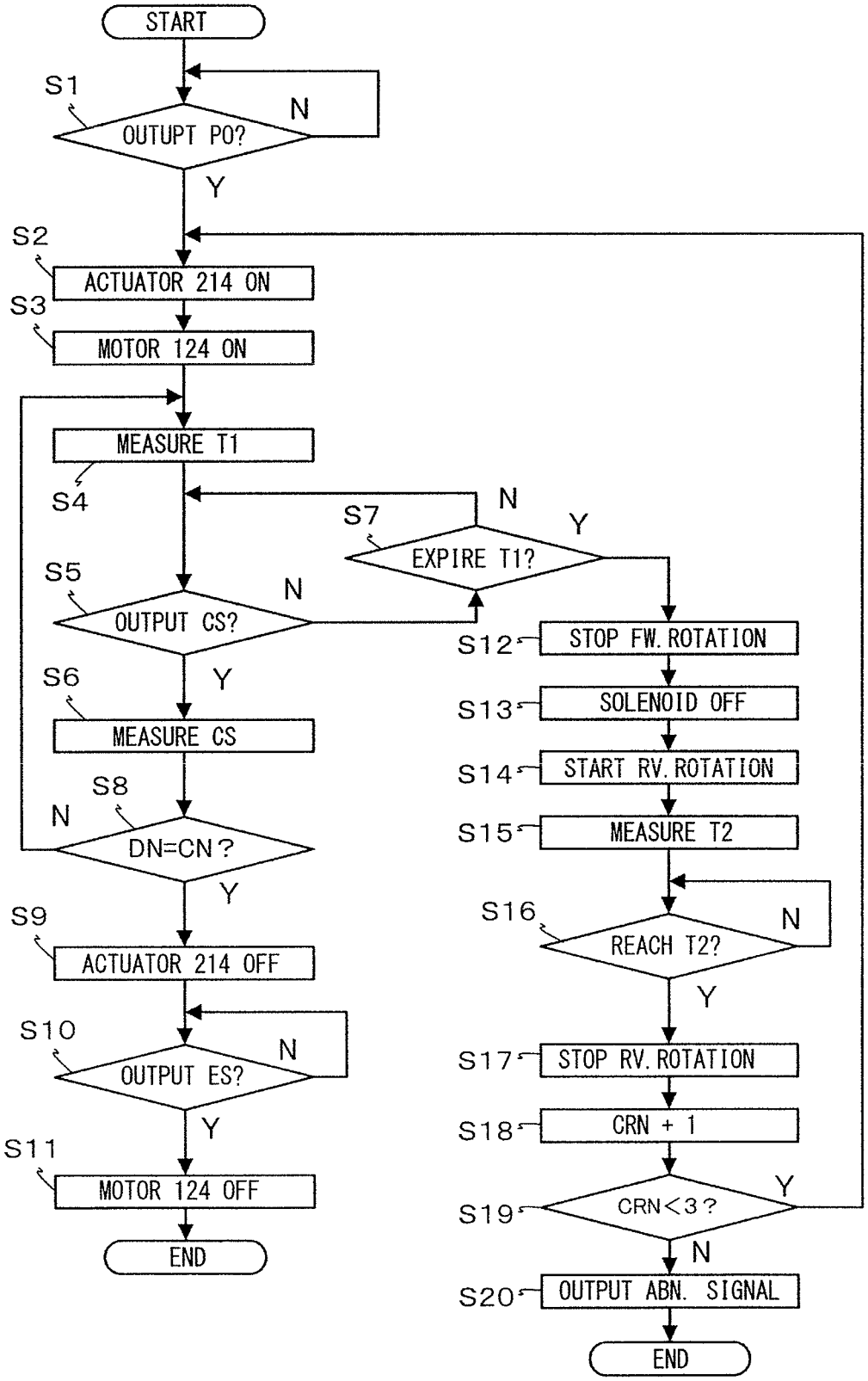
FIG. 14 is a flowchart showing the operation of the control circuit used in the coin dispensing apparatus according to the first embodiment of the present invention.

Next, the control circuit 122 will be explained below with reference to FIG. 13.

The control circuit 122 has the function of receiving a dispensing instruction PO of the coins C from the control section (not shown) of an upper system or device (e.g., a register), a phase signal ES of the rotary disk 108 from the rotary encoder 127, and a coin signal CS from the coin sensor 118, and turning on or off the electric actuator 213 serving as the actuator 200 in accordance with a predetermined program. This means that the control circuit 122 has the function of energizing or de-energizing the electromagnetic actuator 214 and the function of instructing the electric motor 124 to rotate in the forward or reverse direction or to stop. In this embodiment, the control circuit 122 is configured by a microcomputer 286.

When the control circuit 122 receives a dispensing signal PO to dispense a predetermined number of the coins C from the control section of the upper device, the control circuit 122 magnetizes the electromagnet 218 of the electromagnetic actuator 214, thereby moving the position selector 198 to the dispensing assisting position AP by way of the output rod 202 and the attachment piece 222, and moving the stopper 120 to the non-blocking position NSP by way of the interlocking device 242. As a result, the guide pin 112 is located at the guiding position GP.

Moreover, when the control circuit 122 receives a dispensing signal PO, the control circuit 122 outputs a forward rotation signal to the electric motor 124 to rotate the rotary disk 108 in the forward direction by way of the output shaft 125, thereby dispensing a predetermined number of the coins C. More specifically, as described previously, the coins C moved in conjunction with the rotation of the rotary disk 108 are guided to the dispensing opening 110 by the guide pin 112, sandwiched by the coin engaging part 282 of the dispensing opening adjustor 262 and the second guide pin portion 112B, and finally ejected by the resilience force of the resilience spring 226 applied to the second guide pin portion 112B.

When the predetermined number of the coins C have been dispensed, to prevent a further dispensing of the coins C, the electromagnet 218 of the electromagnetic actuator 214 is de-magnetized, thereby moving the position selector 198 to the non-dispensing assisting position NAP and the guide pin 112 to the non-guiding position NGP. After the guide pin 112 is moved to the non-guiding position NGP, the supply of electric power to the electric motor 124 is stopped. In the event of stopping the rotation of the rotary disk 108, the timing for stopping the supply of electric power to the motor 124 is controlled based on the rotation phase signal ES from the encoder 127 and as a result, the movement of the coin C is stopped in such way that the coin C is not overlaid on the advance/retreat hole 129.

The coin C thus dispensed is detected by the metal sensor 230. In response to this, the metal sensor 230 outputs the coin signal CS to the control circuit 122.

The control circuit 122, which has received the coin signal CS, judges whether the coin signal CS is equal to the designated number by the dispensing instruction PO or not, in other words, whether the number included in the coin signal CS from the metal sensor 230 is equal to the designated number or not.

If the number included in the coin signal CS does not reach the designated number, the control circuit 122 keeps energizing the electromagnetic actuator 214. As a result, the guide pin 112 is kept at the guiding position GP, thereby keeping the dispensing action of the coin C.

If the number included in the coin signal CS reaches the designated number, the control circuit 122 de-energizes the electromagnetic actuator 214 and therefore, the position selector 198 is moved to the non-dispensing assisting position NAP. As a result, the guide pin 112 is moved to the non-guiding position NGP and the stopper 120 is moved to the blocking position SP, thereby stopping the dispensing action of the coin C.

On the other hand, when a predetermined number of the coins C have been dispensed based on the dispensing instruction PO, the control circuit 122 stops the supply of electric power to the electric motor 124 in response to the phase signal ES from the rotary encoder 127, thereby stopping the rotation of the rotary disk 108 in such way that the coin C is not overlaid on the advance/retreat hole 129.

[Operation of Coin Dispensing Apparatus]

Next, the operation of the coin dispensing apparatus 100 according to the first embodiment of the present invention having the aforementioned structure will be explained below with reference to FIGS. 14, 15A and 15B, and 16A and 16B.

First, in the step S1, it is judged whether the dispensing instruction PO (i.e., the designated dispensing number DN of the coins C) is outputted or not from the control section of the upper system. If the dispensing instruction PO is outputted, the operation flow advances to the step S2, and if the dispensing instruction PO is not outputted, the step S1 is repeatedly carried out. This process is repeated at intervals of a predetermined time. In this embodiment, it is supposed that the designated dispensing number DN is set at 3.

Next, in the step S2, the control circuit 122 supplies electric power to the electromagnetic actuator 214 to magnetize the electromagnet 218 thereof. Thereafter, the operation flow advances to the step S3.

In the step S2, Due to the magnetization of the electromagnet 218 of the actuator 214, the output rod 212 of the actuator 214 is pulled into the body 216 thereof. Then, the position selector 198 is rocked counterclockwise in FIG. 10 by way of the attachment piece 222 engaged with the output rod 212, reaching the dispensing assisting position AP. As a result, the guide pin 112 is moved to the guiding position GP and the linking portion 260 presses the driven lever 258 upward. Thus, the rocking lever 257 (the interlocking member 246) is rocked around the third supporting shaft 256 and the U-shaped part 248 presses the retainer portion 238 of the stopper 120 downward. As a result, the top end of the stopper 120 is retreated into the appearance/disappearance hole 228.

In the step S3, the electric motor 124 is activated. Thereafter, the operation flow advances to the step S4. In the step S3, due to the activation of the motor 124, the rotary disk 108 is rotated in the forward direction by way of the output shaft 125 of the motor 124. Due to the rotation of the disk 108, some of the coins C stored in the coin storing bowl 106 are dropped into the apertures 136 of the disk 108. The coins C thus dropped into the apertures 136 are then pressed by the pressing members 146 to be moved along the carrying path MP formed on the base 104. In this way, the coins C which are being moved by the first pressing members 146A are guided toward the side of the dispensing opening 110 by the first and second guide pin portions 112A and 112B.

Due to the movement of the coins C toward the side of the dispensing opening 110, the coins C will be able to be guided by the coin engaging part 282 of the dispensing opening adjustor 262. During such the time period, the pressing action of the first pressing members 146A to the coins C is maintained. For this reason, the second guide pin portion 112B is rocked against the resilience force of the resilience spring 226 to reach the position shown by a broken line in FIG. 15B.

During this process, the coins C are further moved along the radial direction of the disk receiving hole 126. In this state, the coins C are moved by only the second pressing members 146B. Finally, the center CC of the coin C exceeds the first line L1 that connects the contact point of the second guide pin portion 112B and the periphery of the coin C and the contact point of the coin C and the coin engaging part 282 at the position shown in FIG. 15A. As a result, the coin C that has exceeded the line L1 is vigorously ejected by the resilience force of the spring 226 to the dispensing passage 114.

The coin C thus ejected to the dispensing passage 114 is detected by the metal sensor 230. In response, the metal sensor 230 outputs the coin signal CS.

After the coin C is ejected to the dispensing passage 114 in this way, the guide pin 112 is rocked until the guide pin 112 is engaged with the rocking motion limiter 204 due to the resilience force of the spring 226, returning to the guiding position GP.

In the case where the guide pin 112 is kept at the guiding position GP subsequently to this return, the coins C are ejected in the same way as described above one by one.

In the step S4, measurement of the dispensing judging time T1 is started. Thereafter, the flow advances to the step S5. The "dispensing judging time T1" in the step S4 is a reference time for judging whether it is an abnormal state or not. For example, the abnormal state is the state where the coins C supposed to have been dispensed are not detected by the metal sensor 230 through the whole dispensing judging time T1, in other words, none of the coins C are not dispensed to the dispensing passage 114 in spite of the state where the coins C are to be dispensed. The dispensing judging time T1 is usually set at about 3 seconds, for example.

In the step S5, it is judged whether the coin signal CS is outputted from the metal sensor 230 or not. If the coin signal CS is outputted from the metal sensor 230, the flow advances to the step S6, and if the coin signal CS is not outputted from the metal sensor 230, the flow advances to the step S7. As explained above, when the metal sensor 230 detects the coin C and outputs the coin signal CS, the coin dispensing apparatus 100 operates successfully or normally and thus, the flow advances to the next step S6 for the normal operation.

In the step S7, it is judged whether the dispensing judging time T1 has expired or not. If the time T1 has not expired, the flow is returned to the step S5. If the time T1 has expired, the flow advances to the step S12. Specifically, since the guide pin 112 is located at the guiding position GP in the step S2 and the rotary disk 108 is rotated in the step S3, the coin C is to be dispensed and the coin signal CS is to be outputted from the metal sensor 230 within the dispensing judging time T1 in the step S5. However, if the coin signal CS is not outputted even after the dispensing judging time T1 has expired in the step S7, it is judged that a coin jam has occurred and then, the reverse rotation function of the rotary disk 108 corresponding to the step S12 and its subsequent ones is performed, thereby eliminating the coin jam automatically.

In the step S6, the number of the coin signals CS is counted whenever the coin signal CS is outputted. Thereafter, the flow advances to the step S8. Since this is the first time, "1" is counted. In other words, the number of the dispensed coins C is counted as "1".

In the step S8, it is judged whether the dispensing number CN of the coins C is equal to the designated dispensing number DN or not, in other words, whether the dispensing number CN of the coins C has reached the designated dispensing number DN or not. If the dispensing number CN has reached the designated dispensing number DN, the flow advances to the step S9. If the dispensing number CN has not reach the designated dispensing number DN, the flow returns to the step S4. This means that whether the designated predetermined number of the coins C was dispensed or not is judged in the step S8.

In this embodiment, the designated dispensing number DN is set at 3. Since the dispensing number CN thus counted from the coin signal CS this time is 1, it is judged that the dispensing number CN has not reached the designated dispensing number DN. So, the flow is returned to the step S4 and the dispensing action of the coins C continues.

In the event that the dispensing action of the coins C continues, as explained above, the coins C are ejected by the guide pin 112 one by one, and the coin signal CS is outputted from the metal sensor 230 at every dispensing action. Therefore, two more coins C are further dispensed later and the dispensing number CN thus counted reaches 3, the flow advances to the step S9.

In the step S9, the electromagnetic actuator 214 is de-energized. Thereafter, the flow advances to the step S10. In the step S9, due to the de-energization of the actuator 214, the position selector 198 is moved to the non-dispensing assisting position NAP by the resilience force of the spring 220 and the guide pin 112 is moved to the non-guiding position NGP. In conjunction with this movement of the position selector 198, the pressing action of the linking portion 260 to the rocking lever 257 (the interlocking member 246) will be eliminated. Thus, the stopper 120 is pushed upward by the biasing force of the spring 252 as the biasing member 250, and the stopper part 232 of the stopper 120 is protruded from the appearance/disappearance hole 228 to the dispensing passage 114 adjacent to the dispensing opening 110. In this way, the stopper 120 is located at the blocking position SP.

In this state where the guide pin 112 is located at the non-guiding position NGP and the stopper 120 is located at the blocking position SP, even if the rotation of the rotary disk 108 continues, there arises no possibility that the coins C moved by the pressing members 146 in conjunction with the rotation of the disk 108 are guided toward the dispensing opening 110 by the guide pin 112. Even if, by any chance, one of the coins C thus moved reaches the dispensing opening 110, this coin C is prevented from being moved furthermore by the stopper 120 located at the blocking position SP. Therefore, the coin C is unable to be moved to the dispensing passage 114. In this case, the coins C are merely circulated along the carrying path MP.

In the step S10, it is judged whether the position signal ES which is suitable to halt of the rotary disk 108 has been outputted or not from the rotary encoder 127. If such the position signal ES has been outputted, the operation flow advances to the step S11, and if such the position signal ES has not been outputted, the step S10 is repeated. This is to detect the timing of halting the supply of electric power to the electric motor 124 in such a way that the rotary disk 108 does not stop in the state where the coin C is opposed to the guide pin 112 (and therefore, the first advance/retreat hole 129A and/or the second advance/retreat hole 1293).

In the step S11, the supply of electric power to the electric motor 124 is stopped and thereafter, the operation of the coin dispensing apparatus 100 is finished. Since the supply of electric power to the motor 124 is stopped, the rotation of the rotary disk 108 will stop after some rotation(s) caused by inertia. Since the timing of stopping the electric power supply is adjusted in such a way that the coin C is not overlaid on the advance/retreat hole 129, there arises no inconvenience for a next dispensing.

In the step S12 that performs the reverse rotation of the rotary disk 108 for automatic elimination of a coin jam, the supply of electric power to the electric motor 124 is stopped. Subsequently, the operation flow advances to the step S13. Because of stopping the electric power supply in the step S12, the rotation of the disk 108 will stop after some rotation(s) caused by inertia.

In the step S13, the electromagnet 218 of the electromagnetic actuator 214 is de-magnetized. Thereafter, the flow advances to the step S14. In the step S13, due to de-magnetization of the electromagnet 218, as explained previously, the guide pin 112 is located at the non-guiding position NGP and the stopper is located at the blocking position SP, thereby preventing the coins C from being dispensed.

In the step S14, the electric motor 14 is rotated in the reverse direction. Subsequently, the flow advances to the step S15. In the step S14, the coins C are also moved in the reverse direction along the carrying path MP in conjunction with the reverse rotation of the motor 124. However, in this step, the guide pin 112 is located at the non-guiding position NGP and therefore, the coins C are moved in the reverse direction without any inconvenience and/or problem.

In the step S15, measurement of the reverse rotation time T2 is started. Thereafter, the flow advances to the step S16. In the step S15, the reverse rotation time T2 determines the rough amount of the reverse rotation of the rotary disk 108. It is sufficient for the disk 108 to be rotated in the reverse direction by at least about 30 degrees. However, it is preferred that the disk 108 is designed to be reverse-rotated by approximately one turn.

In the step S16, it is judged whether the reverse rotation time T2 has reached or not the standard reverse rotation time ST2 which is determined in advance. If the reverse rotation time T2 has reached the standard reverse rotation time ST2, the flow advances to the step S17. If the reverse rotation time T2 has not reached the standard reverse rotation time ST2, the step S16 is repeated. For this reason, the rotary disk 108 is reverse-rotated during the standard reverse rotation time ST2.

In the step S17, the reverse rotation of the electric motor 124 is stopped. Thereafter, the flow advances to the step S18. In the step S17, because of stopping the supply of electric power to the motor 124, the reverse rotation of the rotary disk 108 will stop after some rotation(s) caused by inertia.

In the step S18, the reverse rotation number CRN is counted. Thereafter, the flow advances to the step S19. In the step S18, the reverse rotation number CRN is incremented by "1" whenever the reverse rotation is performed once. Since this is the first-time reverse rotation, "1" is added to the value of the reverse rotation number CRN and stored.

In the step S19, the reverse rotation number CRN is compared with the reverse rotation acceptable number CAN. If the reverse rotation number CRN is equal to or less than the reverse rotation acceptable number CAN, the flow is returned to the step S2. If the reverse rotation number CRN is greater than the reverse rotation acceptable number CAN, the flow advances to the step S20.

In this embodiment, the reverse rotation acceptable number CAN is set at 3. Since this is the first-time reverse rotation, the reverse rotation number CRN is 1 and less than the value 3 of CAN. Thus, the flow is returned to the step S2.

In the case where the flow is returned to the step S2, as explained previously, the guide pin 112 is moved to the guiding position GP and thereafter, the rotary disk 108 is rotated in the forward direction in the step S3, and it is judged that the coins C are not dispensed in the step S5. Moreover, in the step S7, if the coin signal CS from the metal sensor 230 is not outputted within the dispensing judging time T1, the reverse rotation processes in the step S12 to S17 are carried out again. Then, in the step S18, the reverse rotation number CRN is incremented by 1 to have the value of 2. Since this is the second-time reverse rotation, it is judged that reverse rotation number CRN of 2 is less than the value 3 of CAN. Thus, the flow is returned to the step S2 again and the coin C is dispensed again.

In this way, the coin dispensing process and the reverse rotation process are carried out 4 times in total and thereafter, the flow advances to the step S20. In the step S20, an abnormal state signal is outputted to the upper system. Then, the operation of the coin dispensing apparatus 100 is finished.

The aforementioned processes described in the steps S12 to S19 are not essential for the coin dispensing apparatus 100. The operation flow may jump from the step S7 to the step S20 directly.

With the coin dispensing apparatus 100 according to the first embodiment of the present invention, the guide pin 112 is provided in the carrying path MP to be selectively located at the guiding position GP and the non-guiding position NGP, and has the radial guiding function and the selective guiding function as the basic functions. To move selectively the guide pin 112 between the guiding position GP and the non-guiding position NGP, the position selecting device 190 (which comprises the position selector 198 and the actuator 200) is provided as the guide pin driving device.

Moreover, the stopper 120 is provided in the dispensing passage 114 in such a way as to be moved between the blocking position SP and the non-blocking position NSP.

The movements of the guide pin 112 and the stopper 120 are interlocked with each other by the interlocking device 242 and furthermore, they are controlled by the control circuit 122 in such a way that the guide pin 112 is located at the guiding position GP and the stopper 120 is located at the non-blocking position NSP during the dispensing operation, and that the guide pin 112 is located at the non-guiding position NGP and the stopper 120 is located at the blocking position SP during the non-dispensing operation.

Therefore, in the dispensing operation, the coins C which are received in the apertures 136 of the rotary disk 108 and which are moved along the carrying path MP in conjunction with the rotation of the disk 108 are certainly guided toward the dispensing opening 110 by the guide pin 112. Moreover, the coins C thus reached the dispensing opening 110 are not blocked by the stopper 120 in the dispensing passage 114. As a result, no problem will occur during the dispensing operation and the coins C are dispensed smoothly.

After a predetermined number of the coins C are dispensed, in other words, in the non-dispensing operation, the guide pin 112 is located at the non-guiding position NGP and the stopper 120 is located at the blocking position SP due to the operations of the interlocking device 242 and the control circuit 122. Thus, the coins C which are moved along the carrying path MP in conjunction with the rotation of the rotary disk 108 are not guided to the dispensation opening 110 by the guide pin 112. For this reason, the coins C which are moved along the carrying path MP are prevented from reaching the dispensing opening 110 even if the rotary disk 108 is being rotated. This means that there is no anxiety that the coins C are dispensed in error.

Moreover, even if the coins C which are moved along the carrying path MP reach the dispensing opening 110 due to some reason in spite of the guide pin 112 being at the non-guiding position NGP, the coins C are prevented from moving along the dispensing passage 114 by the stopper 120. Accordingly, in this case also, there is no anxiety that the coins C are dispensed in error even if the rotary disk 108 is being rotated.

In this way, with the coin dispensing apparatus 100 according to the first embodiment of the present invention, performing the dispensing operation and stopping the dispensing operation can be selected using the control circuit 122 even if the rotary disk 108 is being rotated and thus, there is no need to stop the rotation of the disk 108 abruptly. This means that there arises no anxiety that the durability of the coin dispensing apparatus 100 degrades.

Accordingly, excessive dispensing or payout of the coins C can be prevented without abruptly stopping the rotary disk 108.

Second Embodiment

Next, a coin dispensing apparatus 300 according to a second embodiment of the present invention will be explained below with reference to FIGS. 18A, 18B, 19A and 19B.

Unlike the aforementioned coin dispensing apparatus 100 according to the first embodiment, the coin dispensing apparatus 300 according to the second embodiment is obtained by applying the present invention to a coin dispensing apparatus having a fixed member 322 and an ejecting roller 324. As explained later, the fixed member 322 and the ejecting roller 324 constitute an ejecting device 320.

In the following description, the explanation about the same structure as that of the first embodiment will be omitted by giving the same reference numerals to the same or equivalent elements for the sake of simplification of description.

Similar to the guide pin 112 used in the coin dispensing apparatus 100 of the above-described first embodiment, a guide pin 302 used in the coin dispensing apparatus 300 is provided in such a way as to overlap with the carrying path MP. The guide pin 302 has the radial guiding function of guiding the coins C which are moved along the carrying path MP in conjunction with the rotation of the rotary disk 108 by the pressing operation of the pressing members 146 (the first and second pressing members 146A and 146B) on the back 108R of the disk 108 toward a radial direction of the disk receiving hole 126 (and therefore, the disk 108).

In this second embodiment, the guide pin 302 is located below the base 104 and is movable in the vertical direction to protrude in the carrying path MP through an advance/retreat hole 306 of the base 104. The guide pin 302 comprises au upper part 302 B and a lower part 302A. The upper part 302B can protrude upward from the advance/retreat hole 306 to reach the carrying path MP. In this embodiment, the lower part 302A is formed as one; however, the upper part 302B is divided into a first part 304A and a second part 304B. Thus, the overall shape of the guide pin 302 is like a two-pronged fork.

The first and second parts 304A and 304B that constitute the upper part 302B of the guide pin 302 are formed cylindrical and are configured to be closely inserted into a circular first advance/retreat hole 306A and a circular second advance/retreat hole 306B formed in the base 104, respectively. The first and second parts 304A and 304B are movable in a perpendicular direction to the base 104, in other words, the vertical direction. Thus, the first and second parts 304A and 304B can be selectively located at the non-guiding position NGP where the first and second parts 304A and 304B are respectively retracted into the first and second advance/retreat holes 306A and 306B, or the guiding position GP (which is placed in the carrying pat MP) where the first and second parts 304A and 304B are respectively protruded from the base 104 through the first and second advance/retreat holes 306A and 306B. The lower end of the lower part 302A is engaged with an interlocking device 308.

Similar to the stopper 120 used in the coin dispensing apparatus 100 of the above-described first embodiment, a stopper 310 used in this second embodiment is provided to overlap with the dispensing passage 114. The stopper 310 is capable of reciprocating motion in the elliptic appearance/disappearance hole 228 along its elongated axis. The appearance/disappearance hole 228 is formed in the passage bottom face 186 of the dispensing passage 114 adjacent to the dispensing opening 110. The stopper 310 can be selectively located at the non-blocking position NSP where the top end of the stopper 310 is retracted into the appearance/disappearance hole 228 and the blocking position SP where the top end of the stopper 310 is protruded from the passage bottom face 186. The upper end part 310T of the stopper 310 has a similar shape to that of the stopper portion 232 of the stopper 120 of the first embodiment, and the lower end part 310U thereof is rockably engaged with the interlocking device 308.

The interlocking device 308 has the function of moving the guide pin 302 and the stopper 310 in opposite phases. More specifically, the guide pin 302 and the stopper 310 are moved in such a way that when the guide pin 302 is located at the guiding position GP, the stopper 310 is located at the non-blocking position NSP, and when the guide pin 302 is located at the non-guiding position NGP, the stopper 310 is located at the blocking position SP. In this structure of the second embodiment, this function can be realized at a low cost. In this embodiment, the interlocking device 308 is realized by a mechanical linking device 309. Here, the mechanical linking device 309 is formed by an interlocking lever 314 which is rockably supported by a fourth supporting shaft 312 at the middle of the lever 314.

An electric actuator 316 has the function of selectively positioning the guide pin 302 and the stopper 310 in opposite phases by selectively moving the interlocking lever 314. In this second embodiment, the electric actuator 316 is realized by an electromagnetic actuator 318.

When the electromagnetic actuator 318 is energized, the guide pin 302 is moved to the guiding position GP and the stopper 310 is moved to the non-blocking position NSP. When the electromagnetic actuator 318 is de-energized, the guide pin 302 is moved to the non-guiding position NGP and the stopper 310 is moved to the blocking position SP due to the resilience force of a returning spring 320*a*. The electromagnetic actuator 318 is energized or de-energized by the control circuit 122 used in the aforementioned first embodiment.

An ejecting device 320 according to the second embodiment comprises a fixed member 322 and an ejecting roller 324.

The fixed member 322 is a guide part whose surface is cylindrical. The fixed member 322 is fixed at a position corresponding to the downstream-side edge 130*d* of the coin guiding wall 130 in the aforementioned first embodiment. In this embodiment, the fixed member 322 is formed by a rotary member 326*a* which is rotatably supported by a shaft 324*a*.

The ejecting roller 324 has the function of ejecting the coin C by sandwiching the coin C by the fixed member 322 and the ejecting roller 324.

In this second embodiment, the ejecting roller 324 is placed on the upper side of the base 104, and a fifth shaft 326 is extended toward the downside of the base 104 through an arc-shaped elongated hole 328 formed in the base 104. The fifth shaft 326 is fixed to one end of a rocking lever 332 which is rockably engaged with a fixed shaft 330, where the fixed shaft 330 is protruded downward from the back of the base 104. The other end of the rocking lever 332 is engaged with one end of a spring 334 and thus, the rocking lever 332 is biased by the spring 334 in such a way that the ejecting roller 324 approaches the fixed member 322. To place the electing roller 324 at the optimum position in accordance with the diameter of the coin C, the position of the fixed shaft 330 is configured to be adjustable.

The ejecting roller 324 is kept at a resting state where the distance between the ejecting roller 324 and the fixed member 322 is shorter than the diameter of the coin C. This resting state may be termed the standby position. If the coin C is pressed into between the fixed member 322 and the ejecting roller 324 by the second pressing member 146B and as a result, the center CC of the coin C exceeds the second line L2 that connects the contact point of the coin C and the fixed member 322 and the contact point of the coin C and the ejecting roller 324, the coin C is ejected by the resilient force of the spring 334.

Next, the operation of the coin dispensing apparatus 300 according to the second embodiment will be explained below.

Figure 19A:
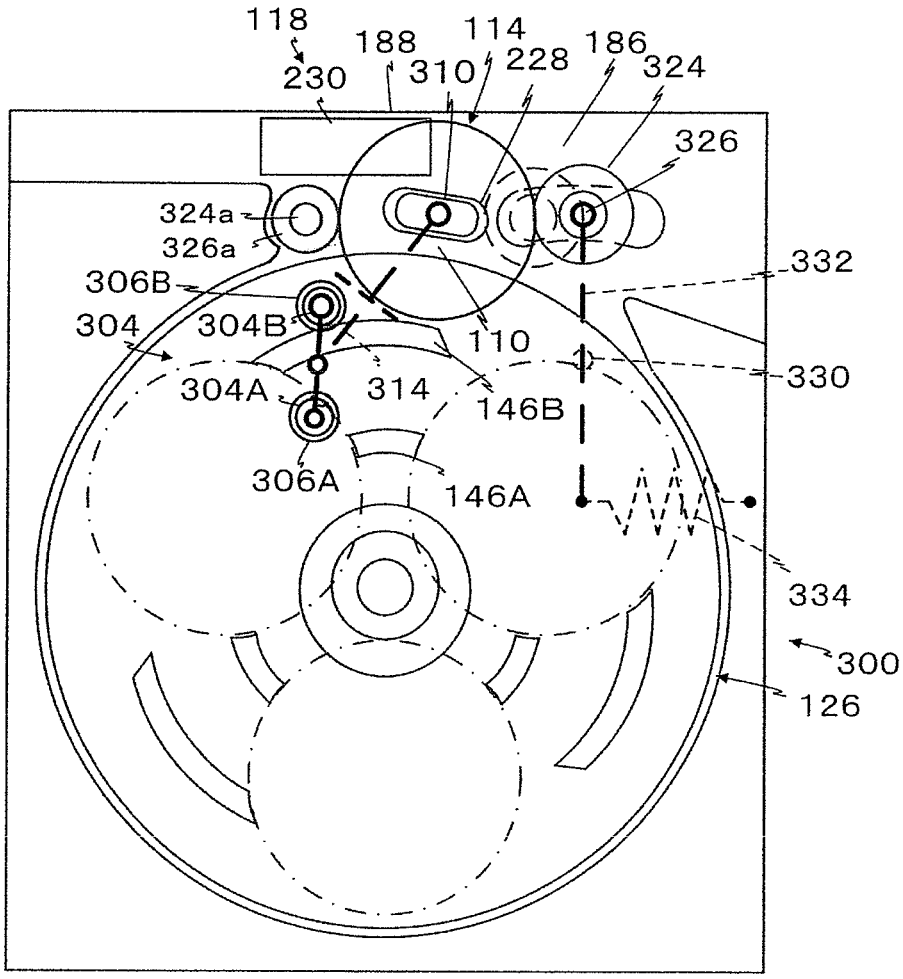
FIG. 19A is a plan view showing the operation of the coin dispensing apparatus according to the second embodiment of the present invention in the dispensing period.
Figure 19B:
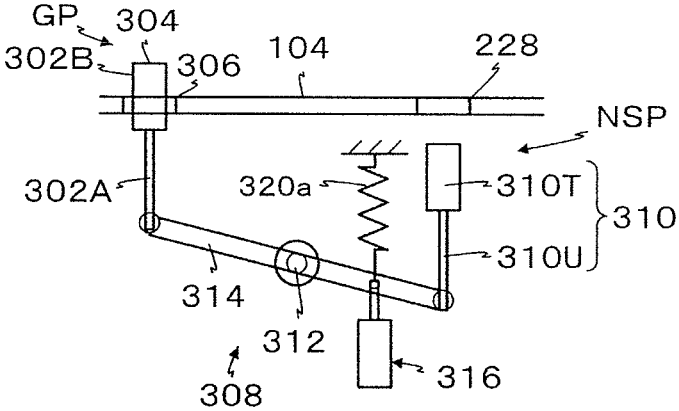
FIG. 19B is a cross-sectional view showing the cooperation of the guide pin and the stopper used in the coin dispensing apparatus according to the second embodiment of the present invention in the dispensing period.

When the dispensing instruction PO is outputted from the control section of the upper system, in the same way as that of the aforementioned first embodiment, first, the electromagnetic actuator 318 is energized and as a result, the interlocking lever 314 is rocked clockwise in FIG. 19A against the resilient force of the returning spring 320*a*. Thus, the guide pin 302 is moved to the guiding position GP and the stopper 310 is moved to the non-blocking position NSP.

Next, when the electric motor 124 is activated and the rotary disk 108 starts to rotate, the coin C is guided in a radial direction of the rotary disk 108 by the first and second parts 304A and 304B of the guide pin 302, and moved toward the dispensing opening 110 in the same way as the aforementioned first embodiment.

Due to such the movements, the coin C is pressed into between the fixed member 322 and the ejecting roller 324 and finally, the coin C is ejected by the roller 324. After the ejection of the coin C, the ejecting roller 324 is returned to the standby position and enters the resting state.

When a designated number of the coins C are dispensed, the electromagnetic actuator 318 is de-energized. Therefore, the interlocking lever 314 is returned to the position shown in FIGS. 19A and 19B by the returning spring 320*a*. As a result, the stopper 310 is moved to the blocking position SP and the guide pin 302 is moved to the non-guiding position NGP. For this reason, even if the rotary disk 108 is being rotated, there is no possibility that the coin C is dispensed.

In the event of a coin jam where the disk 108 is to be rotated in the reverse direction, the electromagnetic actuator 318 is not energized. Thus, the stopper 310 is kept at the blocking position SP and the guide pin 302 is kept at the non-guiding position NGP, which means that the coins C are not dispensed similar to the first embodiment.

With the coin dispensing apparatus 300 according to the second embodiment of the present invention, the guide pin 302, the stopper 310, and the interlocking device 308 are provided instead of the guide pin 112, the stopper 120, and the interlocking device 242 used in the coin dispensing apparatus 100 of the first embodiment. Therefore, it is apparent that the same advantages as those of the coin dispensing apparatus 100 of the first embodiment are obtained.

Third Embodiment

Figure 20:
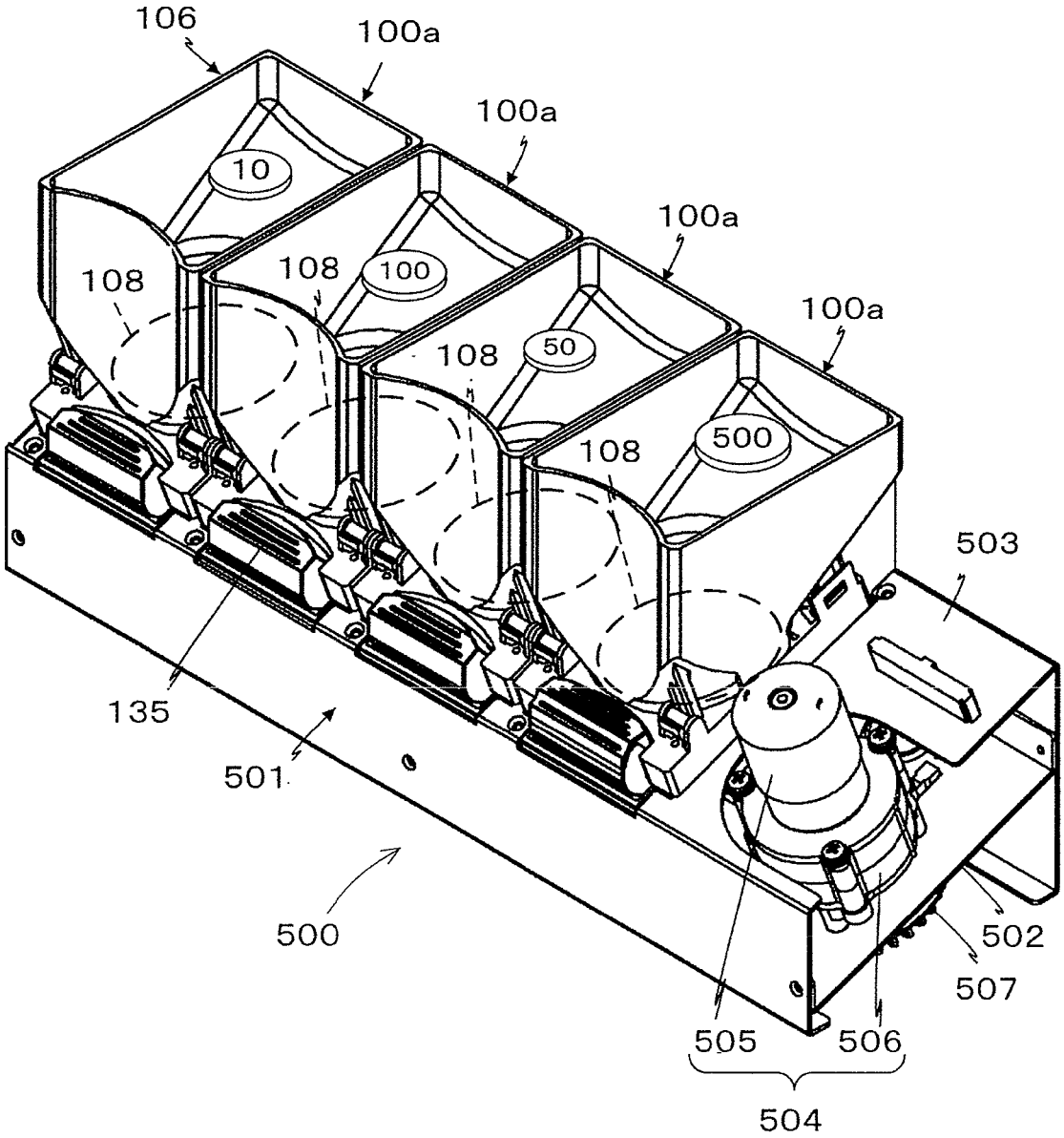
FIG. 20 is a perspective view of a coin dispensing apparatus according to a third embodiment of the present invention.

FIG. 20 shows a coin dispensing apparatus 500 according to a third embodiment of the present invention.

The coin dispensing apparatus 500 according to the third embodiment is configured to make it possible to dispense four types of coins C, i.e., 10 yen, 100 yen, 50 yen and 500 yen, where the four coin dispensing apparatuses 100 according to the aforementioned first embodiment are combined together.

In the coin dispensing apparatus 500 according to the third embodiment, as shown in FIG. 20, the four coin dispensing apparatuses 100 according to the first embodiment are fixed in line on the upper plate 503 of a chassis 501. The four rotary disks 108 of the four apparatuses 100 are driven by a single common driving device 504 instead of individually driving the four disks 108 by the electric motors 124 as used in the first embodiment.

The common driving device 504 comprises an electric motor 505, a reduction gear device 506 for reducing the rotation speed of the motor 505, and a driving gear 507 for driving the four disks 108 of the apparatuses 100. The motor 505 and the reduction gear device 506 are fixed onto an intermediate base 502 which is fixed to the chassis 501. The rotation of the motor 505 is transmitted to the four disks 108 by way of the driving gear 507 after speed reduction by the reduction gear device 506.

Since the four coin dispensing apparatuses 100 of the above-described first embodiment are combined together, it is apparent that the coin dispensing apparatus 500 of the third embodiment has the same advantages as those of the apparatus 100 of the first embodiment.

In addition, as seen from this third embodiment, the coin dispensing apparatuses 100 of the first embodiment may be used in combination as necessary. This is applicable to the coin dispensing apparatuses 300 of the second embodiment.

Other Embodiments

It is needless to say that the present invention is not limited to the above-described embodiments and their variations. Any other modification is applicable to these embodiments and variations.

For example, with the above-described first to third embodiments of the present invention and their variations, the guide pin or member and the stopper are bar-shaped. However, the present invention is not limited to this. The guide pin or member and the stopper may have any other shape as long as their necessary functions are realized.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A coin dispensing apparatus comprising:

a rotary disk having apertures for receiving coins which are supplied from a coin source;

a circular carrying path along which the coins received in the apertures are moved in conjunction with rotation of the disk;

a guide member for guiding the coins which are moved along the carrying path toward a dispensing opening formed in the carrying path; and a dispensing passage through which the coins guided by the guide member are moved from the dispensing opening toward a coin outlet;

wherein a guide member driving device is provided for moving the guide member between a guiding position where the coins which are moved along the carrying path are guided toward the dispensing opening and a non-guiding position where the coins which are moved along the carrying path are not guided toward the dispensing opening;

a stopper is provided in such a way as to be moved between a blocking position where the coins are blocked in the dispensing passage and a non-blocking position where the coins are able to pass through the dispensing passage;

an interlocking device is provided for interlocking the guide member and the stopper in such a way that the guide member is located at the non-guiding position when the stopper is located at the blocking position, and that the guide member is located at the guiding position when the stopper is located at the non-blocking position; and a controller is provided for controlling the guide member and the stopper in such a way that the guide member is located at the guiding position and the stopper is located at the non-blocking position during a dispensing operation, and that the guide member is located at the non-guiding position and the stopper is located at the blocking position during a non-dispensing operation.

2. The coin dispensing apparatus according to claim 1, wherein the interlocking device comprises a mechanical linking device or mechanism.

3. The coin dispensing apparatus according to claim 2, wherein the mechanical linking device or mechanism as the interlocking device comprises an interlocking lever formed integrally with the guide member, a rocking lever rockably supported by a shaft and linked with the stopper, and an actuator;

and wherein when the guide member is moved to the non-guiding position by the actuator, the interlocking lever moves the stopper to the blocking position against a resilient force by way of the rocking lever, and when the guide member is moved to the guiding position by the actuator, the interlocking lever is detached from the rocking lever and the stopper is moved to the non-blocking position by the resilient force.

4. The coin dispensing apparatus according to claim 1, wherein the interlocking device comprises an electric actuator.

5. The coin dispensing apparatus according to claim 1, wherein the stopper is structured to protrude from a bottom of the dispensing passage and to sink below the bottom of the dispensing passage; and the guide member is rockably supported by a shaft and is biased resiliently toward the guide position, wherein the guide member is movable to the non-guide position by an actuator.

6. The coin dispensing apparatus according to claim 1, further comprising:

a rocking motion limiter provided at a front position with respect to a rocking direction of the guide member;

a spring receiver provided at a rear position with respect to the rocking direction of the guide member; and a spring provided between the spring receiver and the guide member, wherein the spring resiliently biases the guide member toward the rocking motion limiter.

7. The coin dispensing apparatus according to claim 1, wherein the guide member driving device comprises a position selector; and the position selector is selectively located between a dispensing assisting position where the guide member is located at the guiding position and a non-dispensing assisting position where the guide member is located at the non-guiding position.

8. The coin dispensing apparatus according to claim 1, further comprising a rotary encoder for detecting a rotation phase of the rotary disk;

wherein rotation of the rotary disk is stopped based on a rotation phase signal from the rotary encoder in such a way that the coins are not overlapped with a protruding position of the guide member.

9. A coin dispensing apparatus comprising:

a body;

a rotary disk provided rotatably on the body, wherein the disk has apertures for receiving coins;

a driving device for rotating the disk;

a coin source for supplying coins to the apertures of the disk;

a circular carrying path, formed on or in the body, along which the coins received in the apertures of the disk are moved in conjunction with rotation of the disk;

a dispensing opening, communicating with the carrying path, for allowing the coins to be moved from the carrying path toward a coin outlet;

a dispensing passage through which the coins are moved from the dispensing opening toward the coin outlet;

a movable guide member, wherein the guide member is selectively located at a guiding position where the coins which are moved along the carrying path are guided by the guide member toward the dispensing opening or a non-guiding position where the coins which are moved along the carrying path are not guided by the guide member;

a movable stopper, wherein the stopper is selectively located at a blocking position where the coins are blocked in the dispensing passage by the stopper or a non-blocking position where the coins are not blocked to pass through the dispensing passage;

an interlocking device for interlocking the stopper and the guide member in such a way that the guide member is located at the non-guiding position when the stopper is located at the blocking position, and that the guide member is located at the guiding position when the stopper is located at the non-blocking position; and a controller for controlling the stopper and the guide member in such a way that the guide member is located at the guiding position and the stopper is located at the non-blocking position during a dispensing operation, and that the guide member is located at the non-guiding position and the stopper is located at the blocking position during a non-dispensing operation.

10. The coin dispensing apparatus according to claim 9, wherein the stopper is structured to protrude from a bottom of the dispensing passage and to sink below the bottom of the dispensing passage.

11. The coin dispensing apparatus according to claim 9, wherein the guide member is rockably supported by a shaft and is biased resiliently toward the guide position; and the guide member is movable to the non-guide position by an actuator.

12. The coin dispensing apparatus according to claim 9, further comprising a mechanical linking device or mechanism as the interlocking device;

wherein the mechanical linking device or mechanism comprises an interlocking lever formed integrally with the guide member, a rocking lever rockably supported by a shaft and linked with the stopper, and an actuator;

and wherein when the guide member is moved to the non-guiding position by the actuator, the interlocking lever moves the stopper to the blocking position against a resilient force by way of the rocking lever, and when the guide member is moved to the guiding position by the actuator, the interlocking lever is detached from the rocking lever and the stopper is moved to the non-blocking position by the resilient force.

13. The coin dispensing apparatus according to claim 9, further comprising:

a rocking motion limiter provided at a front position with respect to a rocking direction of the guide member;

a spring receiver provided at a rear position with respect to the rocking direction of the guide member; and a spring provided between the spring receiver and the guide member;

wherein the spring resiliently biases the guide member toward the rocking motion limiter.

14. The coin dispensing apparatus according to claim 9, wherein the guide member driving device comprises a position selector; and the position selector is selectively located between a dispensing assisting position where the guide member is located at the guiding position and a non-dispensing assisting position where the guide member is located at the non-guiding position.

15. The coin dispensing apparatus according to claim 9, further comprising a rotary encoder for detecting a rotation phase of the rotary disk;

wherein rotation of the rotary disk is stopped based on a rotation phase signal from the rotary encoder in such a way that the coins are not overlapped with a protruding position of the guide member.

* * * * *